US005785440A

United States Patent [19]

Nishikawa et al.

[11] Patent Number: 5,785,440

[45] Date of Patent: Jul. 28, 1998

[54] FORM FEEDING STABILIZATION DEVICE

[75] Inventors: Tomoyuki Nishikawa, Tokyo; Yoshimi Saito, Niigata-ken, both of Japan

[73] Assignee: Asahi Kogaku Kogyo Kabushiki Kaisha, Tokyo, Japan

[21] Appl. No.: 620,305

[22] Filed: Mar. 22, 1996

[30] Foreign Application Priority Data

Mar. 25, 1995 [JP] Japan ..... 7-091258

[51] Int. Cl.[6] ..... B41J 11/42; G03G 15/20

[52] U.S. Cl. ..... 400/618; 400/593; 399/328; 399/384

[58] Field of Search ..... 400/586, 618, 400/578, 582, 593, 596, 611, 619; 399/320, 328, 384

[56] References Cited

U.S. PATENT DOCUMENTS

| | | | |
|---|---|---|---|
| 4,912,490 | 3/1990 | Negoro et al. . | |
| 4,998,835 | 3/1991 | Negishi et al. . | |
| 5,023,667 | 6/1991 | Negoro et al. . | |
| 5,063,416 | 11/1991 | Honda et al. . | |
| 5,187,528 | 2/1993 | Nishikawa et al. . | |
| 5,210,583 | 5/1993 | Monma . | |
| 5,315,359 | 5/1994 | Nishikawa et al. . | |
| 5,423,620 | 6/1995 | Tokarin | 400/618 |
| 5,475,481 | 12/1995 | Nishikawa et al. . | |
| 5,493,377 | 2/1996 | Nishikawa et al. . | |
| 5,516,220 | 5/1996 | Ishikawa et al. . | |
| 5,549,401 | 8/1996 | Ishikawa et al. | 400/618 |

*Primary Examiner*—John S. Hilten
*Attorney, Agent, or Firm*—Greenblum & Bernstein P.L.C.

[57] ABSTRACT

A motion-absorbing region is formed in a continuous form, and a passively rotatable fixing roller is moved into contact with the continuous form when the motion-absorbing region is formed. The motion-absorbing region absorbs the difference in relative speed between the fixing roller and the continuous form, keeping the difference or delay from being transmitted along the form to the region where a toner image is applied to the form. The electrophotographic transfer of the image to the continuous form is started before the pressure roller is moved into contact with the continuous form. The motion-absorbing region can be a slack region formed by feeding the form while the form is not under tension, or a resilient region formed by applying a resilient biasing device to the form while the form is under tension.

34 Claims, 17 Drawing Sheets

FORM FEEDING STABILIZATION DEVICE

BACKGROUND OF THE INVENTION

The present invention relates to an electrophotographic printer, and more particularly, to a continuous form electrophotographic printer having movable fixing rollers for facilitating feeding of the continuous form.

In a conventional electrophotographic printer, a set of fixing rollers, including a pressure roller and heat roller, is used to fuse a toner image. The recording sheet is nipped between the pressure roller and heat roller to fuse the toner image thereon. Some known devices, using a continuous form as the recording sheet, separate the pressure roller and heat roller when the form is stationary to prevent heating of the continuous form and to allow rapid feeding of the form. To achieve this, one of the rollers may be movable toward and away from the feeding path, while the other is stationary with respect to the feed path. In this case, the roller that is movable away from the feeding path rotates passively, while the other roller is driven to rotate. When printing is resumed or started from this condition, the pressure roller and heat roller are moved to an operating position wherein the continuous form is nipped therebetween.

The feeding of the continuous form is generally controlled such that both tension and feeding speed of the form are maintained at predetermined levels. For example, the continuous form may be fed by means of both the fixing rollers and a pair of sheet discharge rollers downstream of the fixing rollers. In this case, a tractor upstream of the fixing rollers can engage the form in a direction opposite to the feeding direction. That is, during forward feeding, the tractor advances with the form but resists forward feeding, thereby applying tension and controlling the feeding speed of the form.

In this case, the movable, passively rotatable roller can be moved toward the feeding path during feeding of the form. The passive roller contacts the moving form under tension, and must be brought up to the speed of the form by contact thereto. Consequently, the feeding of the form is momentarily delayed upstream of the passive roller, and the tension in the continuous form is momentarily released.

Since there is normally some clearance in the engagement between pins of a tractor belt and feeding holes of a continuous form, backlash in this engagement results when the feeding of the form under tension is delayed upstream of the tractor. Furthermore, since the tractor is engaged in a direction opposite to the feeding direction to provide tension, delay and backlash can be transmitted along the continuous form to the image transfer region upstream of the tractor belt. Consequently, an image being transferred to the form at this time may become blurred or unclear.

SUMMARY OF THE INVENTION

It is therefore an object of the present invention to provide an improved form feeding stabilizing device capable of preventing irregular form feeding of a continuous form when a roller is moved into contact with the continuous form during feeding.

In order to meet the objects of the invention, a form feeding stabilization device for a continuous form electrophotographic printer includes: a first form feeder for feeding the continuous form at a constant speed along a form feeding path; an image transfer station along the form feeding path, for transferring a toner image to the continuous form; fixing rollers along the form feeding path, for fixing the toner image by applying heat and pressure to the toner image, at least one of the fixing rollers being a movable roller movable into and out of contact with the continuous form along the form feeding path between the first feeding device and the second feeding device; a roller moving mechanism for moving the movable roller into and out of contact with the continuous form; and a device for forming a motion-absorbing region in the continuous form to absorb a difference in relative motion between the moving roller and the continuous form.

Accordingly, when the moving roller is moved into contact with the continuous for, the motion-absorbing region takes up any delay created in the continuous form by virtue of the contact thereto. The toner image can therefore be transferred to the continuous form without the disturbance of a delay in feeding.

Preferably, one of the fixing rollers is a heat roller, and the movable roller is a passively rotatable pressure roller for pressing the continuous form against the heat roller.

According to one development of the invention, the form feeding stabilization device further includes a device for engaging the continuous form to isolate the motion-absorbing region of the continuous form from the form feeding path at the image transfer device. In this manner, as the motion-absorbing region takes up the disturbance in the form, delays in feeding are not transmitted to the transfer region, and image transfer therefore proceeds with no loss of image quality. Preferably, the device for engaging the continuous form includes a tractor belt for engaging sprocket holes formed in the continuous form.

Preferably, the form feeding stabilization device includes a tensioning device for applying tension to the continuous form in the motion-absorbing region, the tensioning device including a pair of discharge rollers for feeding the continuous form. In this case, the discharge rollers are downstream of the fixing rollers along the feeding path.

In one preferred embodiment, the tensioning device includes: a movable speed control plate contacting the continuous form; sensors for sensing a position of the movable speed control plate; and a control device for controlling a driving speed of the discharge rollers according to a position of the movable speed control plate. In this case, the discharge rollers preferably rotate at a higher surface circumferential speed than the first form feeder.

In this embodiment, the device for forming a motion-absorbing region preferably includes a control device for controlling the tensioning device to apply tension to the continuous form after the first form feeder feeds the continuous form at a constant speed and after the roller moving device moves the movable roller into contact with the continuous form. According to this timing, any delay caused by the contact of the movable roller to the form is absorbed by the motion-absorbing region before tension is applied with the form, and the delay is therefore not transmitted to the transfer region.

In this case, the control device preferably includes a device for controlling the image transfer station to begin transferring the toner image to the continuous form after the motion-absorbing region is formed in the continuous form and before the roller moving device moves the movable roller into contact with the continuous form. Accordingly, the motion-absorbing region absorbs any delay caused by the moving of the movable roller into contact with the form.

According to the another embodiment, the device for forming a motion-absorbing region includes a biasing device for resiliently biasing the continuous form and a control device for controlling the biasing device to resiliently bias the continuous form after the first form feeder feeds the continuous form at a constant speed, before the tensioning device applies tension to the continuous form, and before the roller moving mechanism moves the movable roller into contact with the continuous form. According to this arrangement, the resiliency of the biasing device can absorb any delay in feeding caused by the contact of the movable roller to the form.

In this case, the control device preferably includes a device for controlling the image transfer station to begin transferring the toner image to the continuous form before the roller moving mechanism moves the movable roller into contact with the continuous form. Thus, although the transfer of the image has started, the resiliency of the biasing device is able to absorb any delays caused when the movable roller contact the form.

Preferably, the biasing device includes: a speed control plate for contacting the continuous form; a resilient member connected to the speed control plate, the resilient member resiliently responsible to movements of the speed control plate; and a mechanism for moving the speed control plate into contact with the continuous form.

In one construction, the mechanism for moving the speed control plate into contact with the continuous form includes: a solenoid connected to the speed control plate and a control device by the control device. In another alternative construction, the mechanism for moving the speed control plate into contact with the continuous form includes: a cam follower connected to the speed control plate; a cam for moving the cam follower; and a motor for moving the cam, the motor being controlled by the control device.

In another aspect of the present invention, a form feeding stabilization device for a continuous form electrophotographic printer, includes: a first feeding device for feeding a continuous form at a constant speed along a feeding path; a device for forming a motion-absorbing region downstream of the first feeding device along the feeding path; an image transfer device for transferring a toner image to the continuous form; a roller moving device for moving a passively rotatable roller into contact with the continuous form downstream of the first feeding device; a tensioning device for applying tension to the continuous form in the motion-absorbing region; and a fixing device for foxing the toner image on the continuous form.

According to this aspect of the invention, after the feeding device begins to feed the form, the motion-absorbing region is formed. Image transfer is then started, and because the form is not under tension, the motion-absorbing region takes up any delay in the feeding of the form caused when the passively rotatable roller is next applied to the form, and the image transfer is not disturbed. Subsequently, when the tension is applied to the form, and fixing of the image is performed.

Preferably, the form feeding stabilization device further includes a heat roller, and the passively rotatable roller is a pressure roller for pressing the continuous form against the heat roller. Further preferably, the tensioning device includes: a pair of driven discharge rollers for applying a tension to the continuous form rollers downstream of the fixing device. In this case, the tensioning device may further include: a movable speed control plate contacting the continuous form; sensors for sensing a position of the movable speed control plate; and a control device for controlling a driving speed of the discharge rollers according to a position of the movable speed control plate. In this manner, the tension of the form may be accurately controlled.

In one preferred embodiment, the device for forming a motion-absorbing region includes: a control device for controlling the tensioning device to apply tension to the continuous form after the first feeding device feeds the continuous form at a constant speed and after the roller moving device moves the passively rotatable roller into contact with the continuous form. According to this timing, any delay caused by the contact of the movable roller to the form is absorbed by the motion-absorbing region before tension is applied to the form, and the delay is therefore not transmitted to the transfer region.

In this case, the control device preferably includes a device for controlling the image transfer device to begin transferring the toner image to the continuous form after the motion-absorbing region is formed in the continuous form and before the roller moving device moves the passively rotatable roller into contact with the continuous form. Accordingly, the motion-absorbing region absorbs any delay caused by the moving of the movable roller into contact with the form.

According to another embodiment of this aspect of the invention, the device for forming a motion-absorbing region includes a biasing device for resiliently biasing the continuous form; and a control device for controlling the biasing device to resiliently bias the continuous form after the first feeding device feeds the continuous form at a constant speed, before the tensioning device applies tension to the continuous form, and before the roller moving device moves the passively rotatable roller into contact with the continuous form. According to this arrangement, the resiliency of the biasing device can absorb any delay in feeding caused by the contact of the movable roller to the form.

In this case, the control device preferably includes a device for controlling the image transfer device to begin transferring the toner image to the continuous form before the roller moving device moves the passively rotatable roller into contact with the continuous form. Thus, although the transfer of the image has started, the resiliency of the biasing device is able to absorb any delays caused when the movable roller contacts the form.

Preferably, the biasing device includes: a speed control plate for contacting the continuous form; a resilient member connected to the speed control plate, the resilient member resiliently responsible to movement of the speed control plate; and a mechanism for moving the speed control plate into contact with the continuous form.

In one construction, the mechanism for moving the speed control plate into contact with the continuous form includes: a solenoid connected to the speed control plate and a control device by the control device. In another alternative construction, the mechanism for moving the speed control plate into contact with the continuous form includes: a cam follower connected to the speed control plate; a cam for moving the cam follower; and a motor for moving the cam, the motor being controlled by the control device.

According to another development of the invention, the form feeding stabilization device further includes a device for removing changes in feeding speed in the motion-absorbing region of the continuous form. In this case, the device for removing changes in feeding speed includes: a second feeding device for feeding the continuous form arranged downstream of the device for fixing, the second device for feeding the continuous form urging the form at a higher feeding speed than the first a device for feeding. In this manner, the speed changes in the motion-absorbing region can be gradually removed, ensuring that the transfer of an image is not disturbed by an abrupt delay in feeding.

In this case, the second feeding device preferably includes a pair of driven rollers, and the first feeding device including a tractor.

In yet another development of the invention, the form feeding stabilization device includes a device for isolating changes in feeding speed in the motion-absorbing region of the continuous form from a portion of the continuous form at which the toner image is transferred. In this manner, as the motion-absorbing region takes up the disturbance in the form, delays in feeding are not transmitted to the transfer region, and image transfer therefore proceeds with no loss of image quality. In this case, the device for isolating changes in feeding speed preferably includes a tractor belt for engaging sprocket holes formed in the continuous form.

DETAILED DESCRIPTION OF THE PREFERRED EMBODIMENTS

Figure 1:
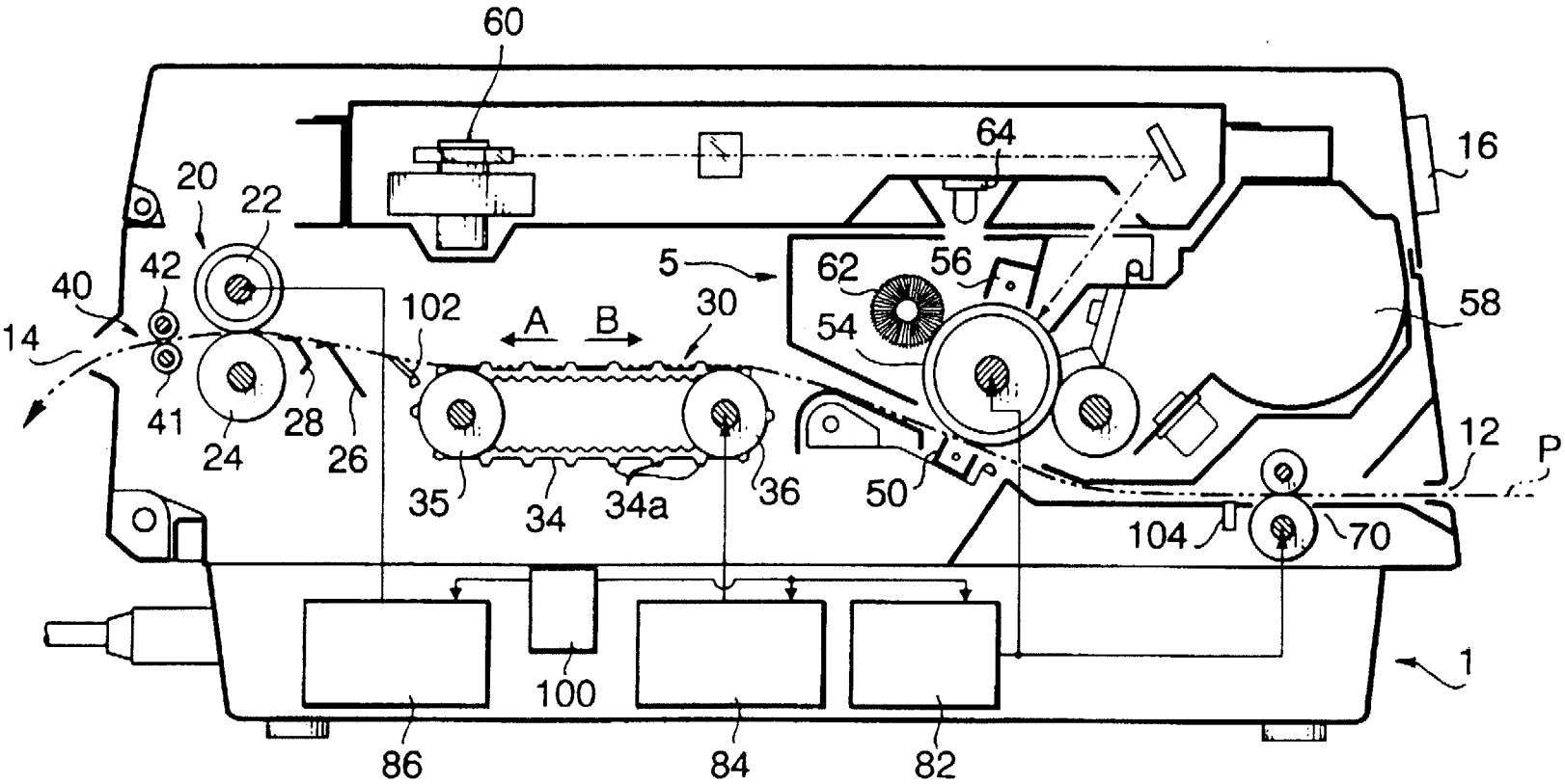
FIG. 1 is a side schematic view showing an electrophotographic printer.

FIG. 1 is a side schematic view showing an electrophotographic printer 1 according to an embodiment of the invention. A continuous form P, having feeding holes Po (shown in FIGS. 7A and 7B) along both lateral sides of the form, and perforations for separating discrete pages of the form, is employed as a recording sheet in the electrophotographic printer 1. The continuous form P (shown by a double-dotted phantom line in FIG. 1) is transferred along a feeding path between a sheet inlet 12 and a sheet outlet 14.

The electrophotographic process is carried out by a process unit 5 including a photoconductive drum 54, a developing unit 58, a cleaning brush 62, a discharging lamp 64, and a charging station 56. A transfer unit 50 and a laser scanning unit 60 also participate in the electrophotographic process.

Along the feeding path from the inlet 12, the transfer unit 50 for transferring a toner image onto the form P, a tractor unit 30 for regulating the feed of the form P, a fixing unit 20 for fusing the toner image onto the form P, and a discharge roller pair 40 for discharging the form P from the printer 1 are arranged in that order. The transfer of the image from the drum 54 to the form P takes place at the transfer unit 50.

A back tension roller pair 70 is provided in the vicinity of the inlet 12 for applying tension to the form P. During the feeding of the continuous form P, the back tension roller pair 70 is always rotated to urge the form P in the reverse direction, maintaining tension. When the form P is fed in a forward direction, the back tension roller pair 70 slips on the surface of the continuous form P to apply a tension thereto. When the continuous form P is fed in a reverse direction, the back tension roller pair 70 feeds the paper in the reverse direction in cooperation with the tractor unit 30. A paper input sensor 104 is provided in the vicinity of the back tension rollers 70 to detect a continuous form P loaded in the printer.

A laser beam modulated in accordance with an image signal is projected from the laser scanning unit 60 (scanning in a main scanning direction), and is directed to the rotating (subscanning) photoconductive drum 54. The photoconductive drum 54 is driven at a constant speed via a gear train (not shown) by a motor 82. The photoconductive surface of the drum 54 is uniformly charged at the charging station 56, and when the surface is exposed to the laser beam, a latent image is formed thereon. Toner is adhered to the latent image by a developing unit 58 to form a toner image. The toner image is transferred onto the recording sheet (form P) by a stronger attractive charge in the form P, generated by a corona charger at the transfer unit 50. The form bearing the toner image is fed downstream, and is fixed by a fixing unit 20, completing the printing for that image.

Any toner remaining on the surface of the drum 54 (after transfer of the toner image to the form P) is removed by the cleaning brush 62. Furthermore, any remaining charge on the surface of the photoconductive drum 54 is discharged at the discharging lamp 64 in preparation for the next image formation.

The tractor unit 30 is provided with a front pulley 35, a drive pulley 36, and an endless tractor belt 34. A belt 34 and pulleys 35, 36 are provided on each lateral side of the feeding path. Each tractor belt 34 has tractor pins 34*a* for engaging feeding holes Po of the form P. The drive pulley 36 is driven by a stepping motor 84 via a gear train (not shown), and is drivable in both forward (arrow A in FIG. 1) or reverse (arrow B in FIG. 1) directions. The motor 84 is a stepping motor, and is controlled to drive the tractor 30 at a constant speed in an open loop system. A paper top sensor 102 is provided downstream of the tractor 30 to detect the leading edge of a continuous form P along the feeding path.

The fixing unit 20 comprises a heat roller 22 and a pressure roller 24, and the discharge roller pair 40 comprises an upper roller 42 and a lower roller 41. The heat roller 22 and lower discharge roller 41 are driven to rotate by a motor 86 via a gear train (not shown).

Figure 2A:
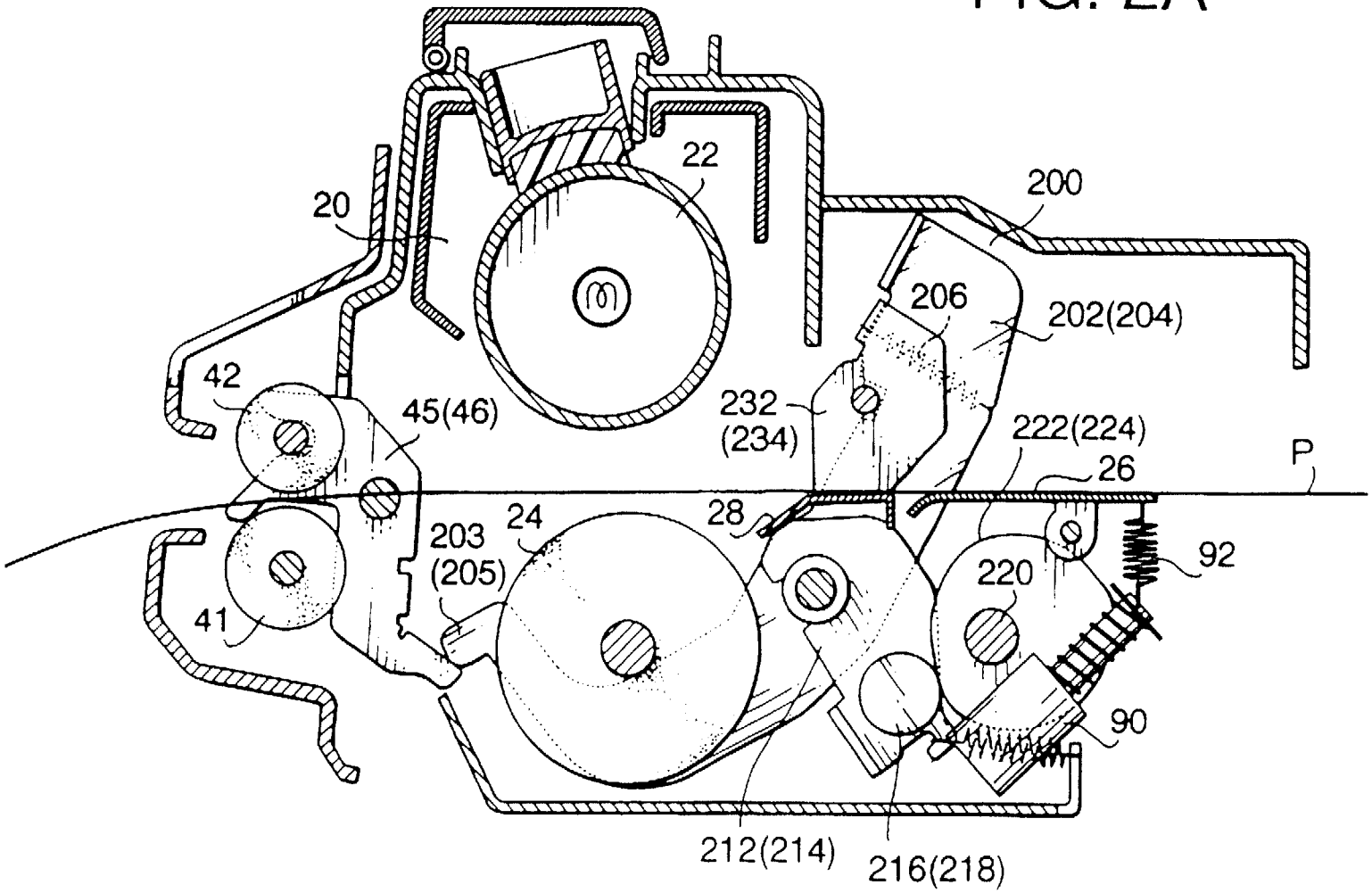
FIGS. 2A through 2C are side views of a fixing unit and a first type of speed control mechanism.
Figure 2B:
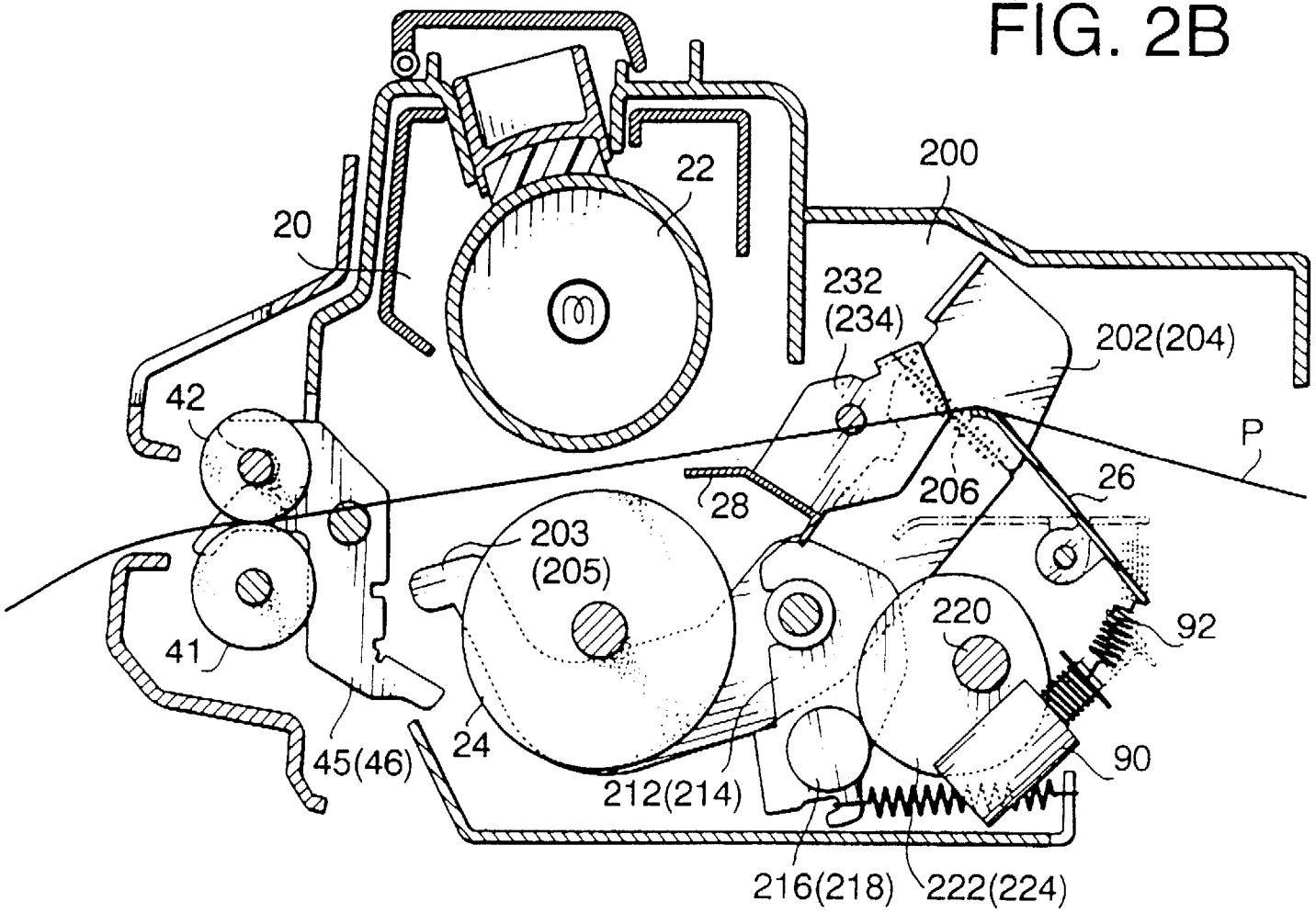
Figure 2C:
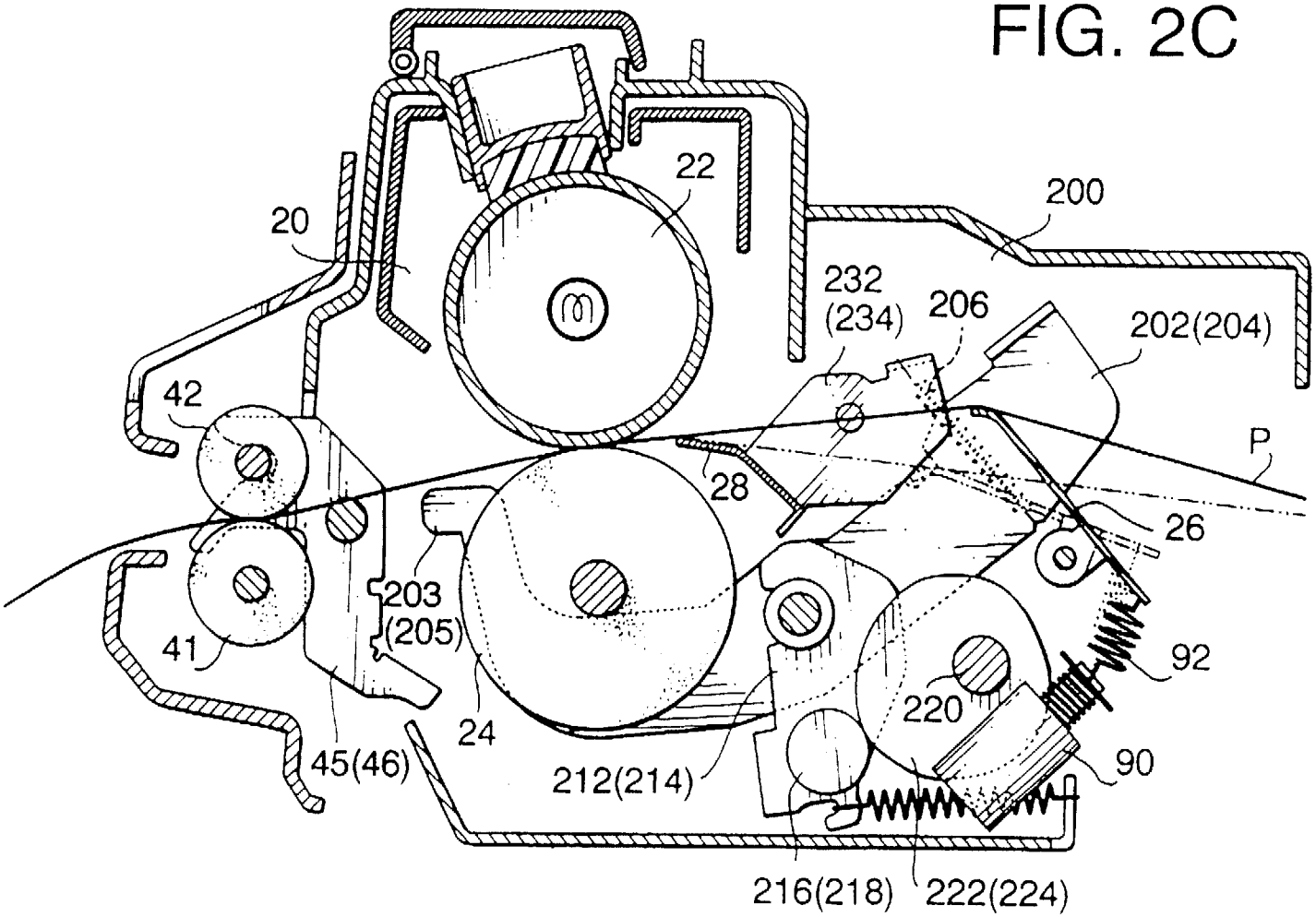

FIGS. 2A through 2C show side views of the fixing unit 20 and vicinity, and a roller retraction mechanism for retracting the pressure roller 24. In FIGS. 2A through 2C, elements distributed symmetrically on both lateral sides of the form feeding path are designated by a first numeral representing the left side (from the view point of the paper insertion end of the printer 1), followed by a second numeral in parenthesis designating the right side.

As shown in FIG. 2A, both end portions of a pivot shaft of the pressure roller 24 are supported by a pair of pressure roller swing arms 202, 204. The pressure roller swing arms 202, 204 are swingable with respect to the body of the printer 1. Cam followers 216, 218 are secured, via members 212, 214, to the pressure roller swing arms 202, 204, respectively. The cam followers 216, 218 are swingable about the same axis as the pressure roller swing arms 202, 204, and the cam followers 216, 218 engage cams 222, 224, respectively. The cams 222 and 224 are mounted on a rotatably supported shaft 220. The shaft 220 is driven by the motor 86 via a gear train (not shown) when an electromagnetic clutch 250 (shown in FIG. 6) is activated.

A pair of guide plate swing arms 232, 234 are swingably supported by the printer body above the pressure roller swing arms 202, 204. The guide plate swing arms 232, 234 respectively support either lateral side of a guide plate 28 extending across and below the form feeding path, and are coupled to the pressure roller swing arms 202, 204, respectively, via a spring. The guide plate 28 is thereby swung together with the pressure roller swing arms 202, 204 to contact the lower side of a continuous form P in the fixing unit 20.

As shown in FIGS. 2A through 2C, the upper discharge roller 42 is swingably supported at either end by swingable discharge roller lift arms 45, 46. The discharge roller lift arms 45, 46 are actuated at an end opposite the upper discharge roller 42 by contact with end portions 203, 205 of the pressure roller swing arms 202, 204, respectively. When the pressure roller swing arms 202 and 204 swing (counterclockwise from the viewpoint of FIGS. 2A through 2C) to move the pressure roller 24 away from the heat roller 22, the end portions 203, 205 press on the actuating end of the discharge roller lift arms 45, 46, respectively, lifting the upper discharge roller 42.

Thus, upon rotation of the cams 222, 224, the pressure roller swing arms 202, 204, respectively, are swung to move the pressure roller 24 between an operating position (shown in FIG. 2C) through an intermediate position (shown in FIG. 2B) to a retracted position (shown in FIG. 2A), and back. Furthermore, the guide plate swing arms 232, 234, and the discharge roller lift arms 45, 46 are swung in response to the swinging movement of the pressure roller swing arms 202, 204 respectively.

In the retracted position (DOWN in FIGS. 9F, 11F, 13F, and 15F) shown in FIG. 2A, the pressure roller 24 and upper discharge roller 42 are moved away from their respective facing rollers and away from contact with the form P.

FIG. 2B shows an intermediate (MID in FIGS. 9F, 11F, 13F, and 15F) position between the retracted position and the operating position of the pressure roller 24. In the intermediate position, the pressure roller 24 is moved away from the heat roller 22, but the discharge rollers 41, 42 of the discharge roller pair 40 still clamp the continuous form P therebetween.

When the pressure roller 24 is moved in the direction of the intermediate and operating positions, the position of the guide plate 28 (guiding the continuous form) is changed, and the upper discharge roller 42 is also moved down to an operating position. In between the intermediate and operating positions, the pressure roller 24 comes in contact with the continuous form.

In the operating position (UP in FIGS. 9F, 11F, 13F, and 15F) shown in FIG. 2C, the pressure roller 24 presses the form P against the heat roller 22 and the upper discharge roller 42 presses the form P against the lower discharge roller 41.

The motor 86 for driving the heat roller 22 and the lower discharge roller 41 is a stepping motor, and during normal forward feeding, drives the lower discharge roller 41 to feed the form P slightly faster (by a predetermined amount) than the tractor 30. In both of the operating and intermediate positions, as the tractor 30 and the form P are positively engaged and the tractor 30 is driven at a constant speed, the continuous form P is normally fed at a constant speed under a controlled tension.

A first type of speed control mechanism using a speed control plate 26 is shown in FIGS. 2A through 2C. The speed control plate 26 is provided at the upstream side of the fixing rollers 20. The speed control plate 26 extends substantially over the entire width of the continuous form P. The speed control plate 26 is rotatable about a pivot shaft. Furthermore, one end of the speed control plate 26 is secured to the plunger of a solenoid 90 via a spring 92. The speed control plate 26 is biased in a clockwise direction (from the viewpoint of FIGS. 2A through 2C) by the spring 92. When the pressure roller 24 and upper discharge roller 42 are in retracted positions, as shown in FIG. 2A, the plunger of the solenoid 90 is extended, and the speed control plate 26 is substantially parallel to the feeding path of the continuous form P.

As shown in FIG. 2B, at a point between the retracted and operating positions of the pressure roller, the solenoid 90 can be actuated, bringing the speed control plate 26 from the parallel position (shown in FIG. 2B by a phantom line) into the form feeding path (shown in FIG. 2B by a solid line).

As shown in FIG. 2C, when the solenoid 90 is actuated, the speed control plate 26 intrudes into the feeding path of the continuous form P, and contacts the lower side of the continuous form P. Depending on the tension applied to the continuous form P, the continuous form P rotates the speed control plate 26 in a counterclockwise direction, against the bias of the spring 92, between a range of operating positions (or "levels"). Operating levels of the continuous form P and speed control plate 26 are shown in FIG. 2C at a lower level (shown by a phantom line, and corresponding to a later-described operating level L2) and an upper level (shown by a solid line, and corresponding to a later-described operating level L4). That is, the speed control plate 26 resiliently intrudes into the feeding path of the continuous form to bias the continuous form P in a direction substantially normal to the feeding path. Furthermore, the speed control plate 26 is rotatable from the operating levels shown in both the clockwise and counterclockwise directions in response to tension applied to the continuous form P.

Figure 3:
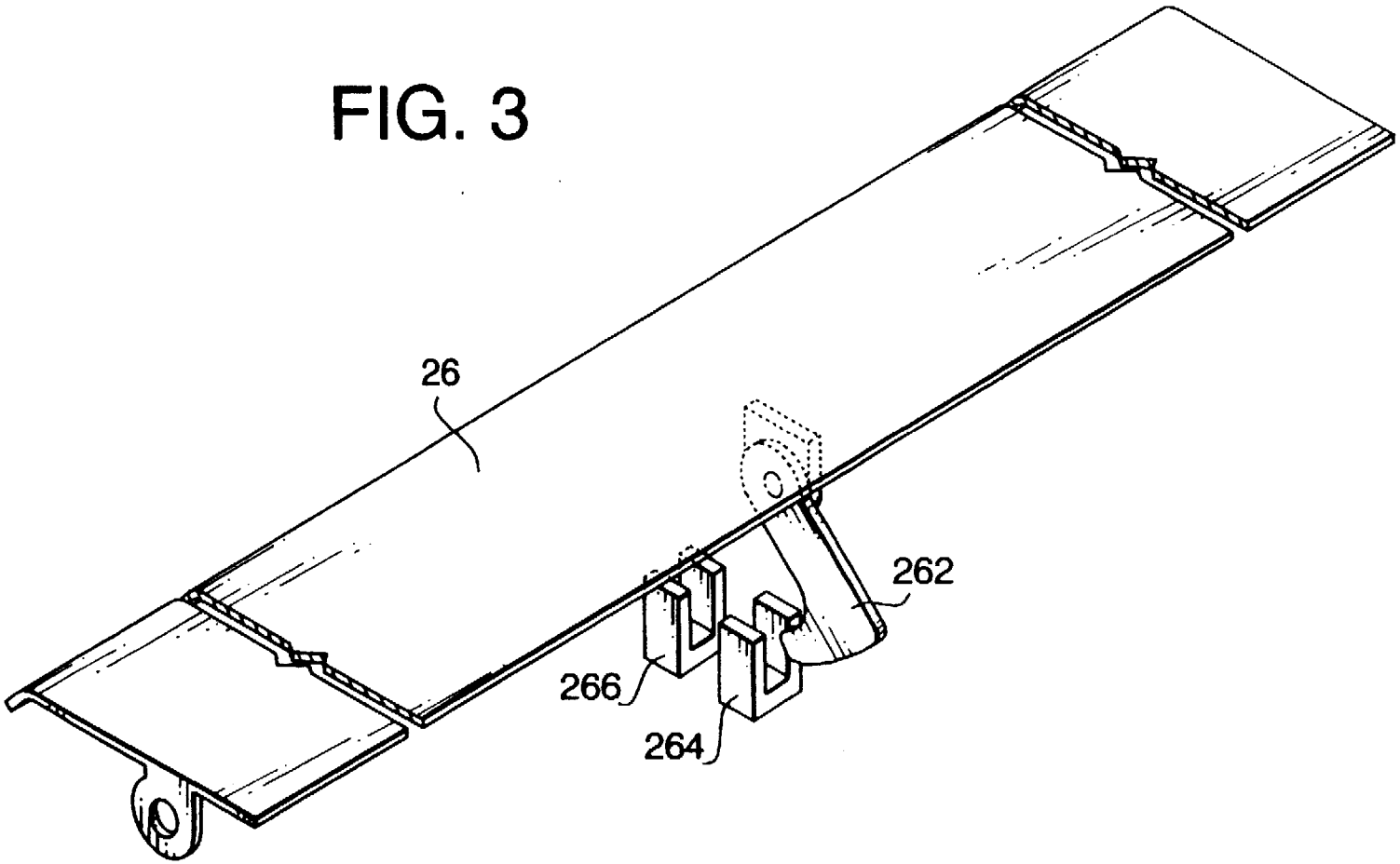
FIG. 3 is a perspective view showing a speed control plate.

FIG. 3 is a perspective view showing the speed control plate 26 utilized in the first type of speed control mechanism. As shown in FIG. 3, the speed control plate 26 has a shutter member 262 attached thereto, and the shutter member 262 can pass through and selectively block one or both of two photointerruptors 266, 264 depending on the angular position of the speed control plate.

Figure 4:
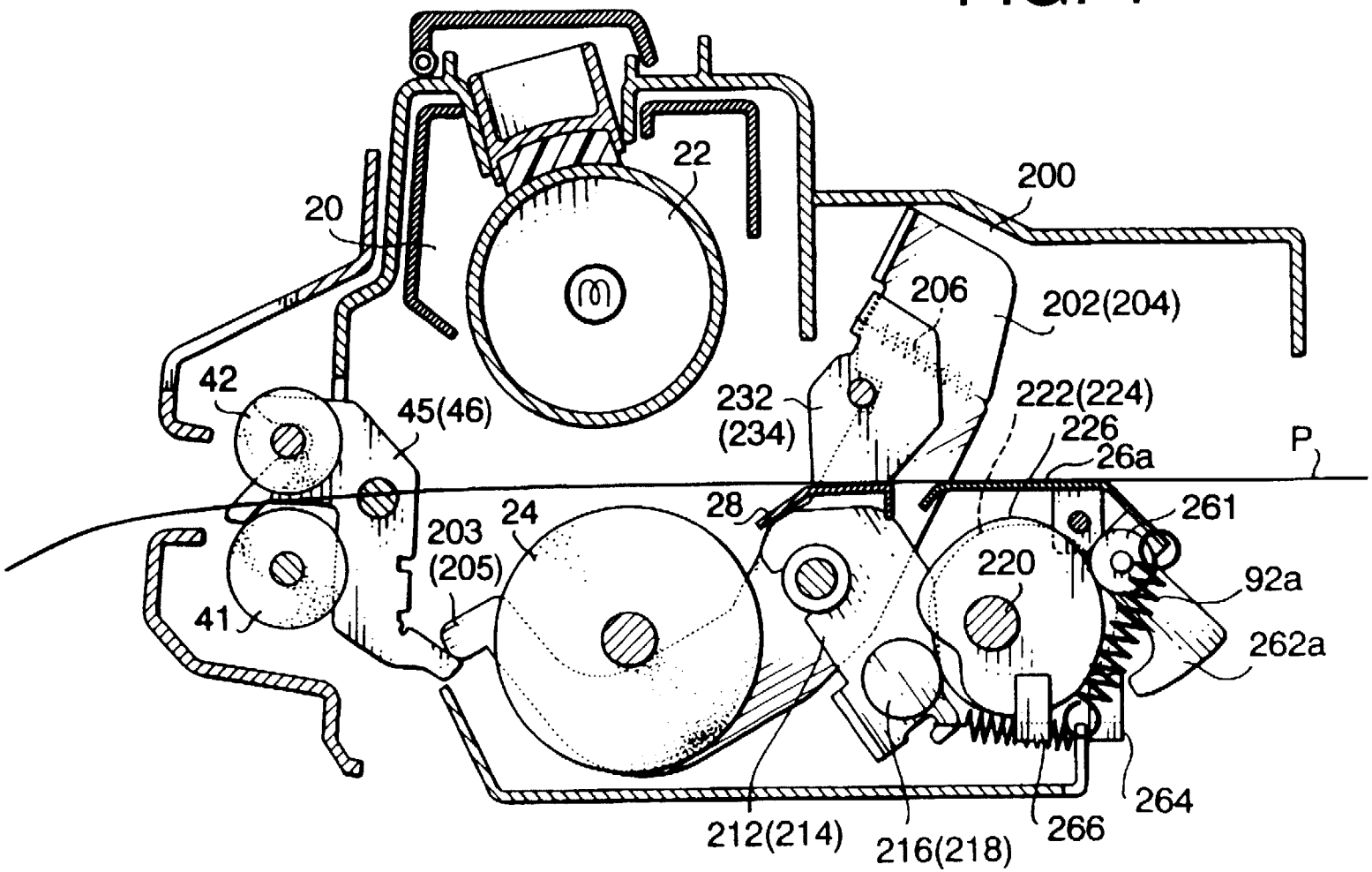
FIG. 4 is a side view of a fixing unit and a second type of speed control mechanism.

FIG. 4 shows a second type of speed control mechanism using a modified speed control plate **26*a*, a cam follower 261, a biasing spring 92*a*, and a plate moving cam 226. The plate moving cam 226 is mounted on the same shaft 220 as the cams 222, 224, and is therefore operated when the electromagnetic clutch 250 is engaged, and rotates at the same time as the cams 222, 224. However, the movement of the modified speed control plate 26*a* is different from that of the pressure rollers, depending on the shape of the plate moving cam 226. In the second type of speed control mechanism, the modified speed control plate 26*a* can be moved into the form feeding path to predetermined positions, depending on the angular position of the plate moving cam 226, as the cam follower 261 follows the plate moving cam 226 under the bias of the spring 92*a*. From such a predetermined position, the modified speed control plate 26*a* is only movable to a lower level (in the counterclockwise direction from the perspective of FIG. 4) against the bias of the spring 92*a*. Also shown in FIG. 4 are a shutter member 262*a*, and photointerruptors 266, 264. The shutter member 262*a* can pass through and selectively block one or both of two photointerruptors 266, 264 depending on the angular position of the speed control plate 26*a***.

FIGS. 5A through 5E show the various levels of the modified speed control plate **26*a* and shutter plate 262*a* of the second type of speed control mechanism. It should be noted that although the second type of speed control mechanism is shown in FIGS. 5A through 5E, the range of movement, dimensions, and detected levels of the first type of speed control mechanism, using the speed control plate 26 and shutter plate 262**, are identical.

Photointerruptors 266 and 264 are arranged where the shutter plate 262 passes. The modified speed control plate **26*a* (or speed control plate 26) is moved in response to the tension applied to the continuous form P, and based upon the inclination of the modified speed control plate, the shutter plate 262*a* interrupts the photointerruptors 266 and 264. Accordingly, by the combination of ON and OFF conditions sensed by photointerruptors 264 and 266**, the tension of the continuous form P is detected.

During paper feeding, the rotational speed of the motor 86 that drives the heat roller 22 and lower discharge roller 41 is controlled depending on the tension applied to the continuous form P, as detected by the photointerruptors 266, 264, for both the first and second types of speed control mechanism.

Figure 5A:
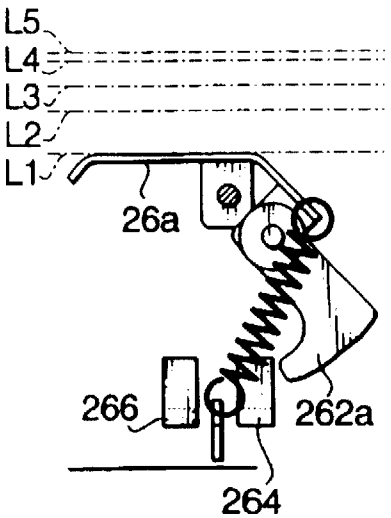
FIGS. 5A through 5E are side schematic views showing position levels of a speed control plate.
Figure 5B:
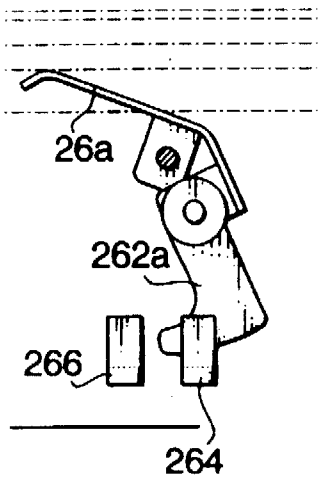
Figure 5C:
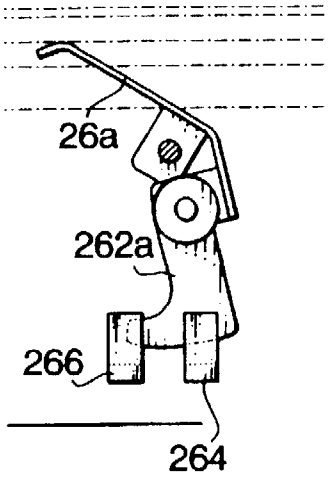
Figure 5D:
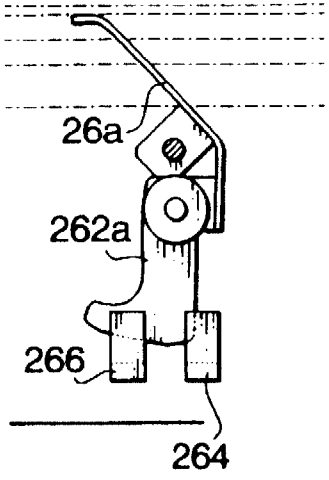
Figure 5E:
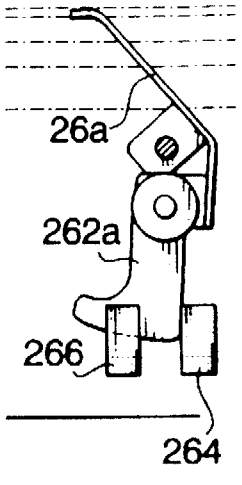

In both the first and second types of speed control mechanism, before the speed control plate is moved into the form feeding path, the continuous form P is at the position level L1 shown in FIG. 5A, an the photointerruptors 264 and 266 are both on. In this case, for the first type of speed control mechanism, as shown in FIG. 2A, when the plunger of the solenoid 90 is extended, the top surface of the speed control plate 26 is substantially horizontal. For the second type of speed control mechanism, the plate moving cam 261 is positioned as shown in FIG. 4, and the top surface of the speed control plater 26 is substantially horizontal.

After the solenoid 90 is actuated (first speed control mechanism), or the plate moving cam 261 is rotated (second speed control mechanism), the speed control plate 26, or modified speed control plate **26*a*, is free to move between the levels L2 to L5 shown in FIGS. 5B through 5E. That is, the inclination of the speed control plate 26, or modified speed control plate 26*a*, depends on the tension in the continuous form P. The spring 92 biasing the speed control plate 26, or the spring 92*a* biasing the modified speed control plate 26*a***, extends or contracts in response to the force applied by the continuous form P.

When the continuous form P and speed control plate 26 (or modified speed control plate **26*a*) is at the level designated L2 (shown in FIG. 5B), the tension in the continuous form P is stronger than the preferred range. At level L2, the photointerruptor 264 is OFF, while the photointerruptor 266 is ON. In this condition, the motor 86** is slowed to decrease tension.

When the continuous form P is positioned at or between levels L3 and L4 (shown in FIGS. 5C and 5D, respectively), the applied tension is in the preferred range. At or between levels L3 and L4, both photointerruptors 264 and 266 are OFF. In this condition, the speed of the motor 86 is maintained.

When the continuous form P and speed control plate 26 (or modified speed control plate **26*a*) is at the level designated L5 (shown in FIG. 5E), the tension in the continuous form P is weaker than the preferred range. At level L5, the photointerruptor 264 is ON, while the photointerruptor 266 is OFF. In this condition, the motor 86** is sped up to increase tension.

Figure 6:
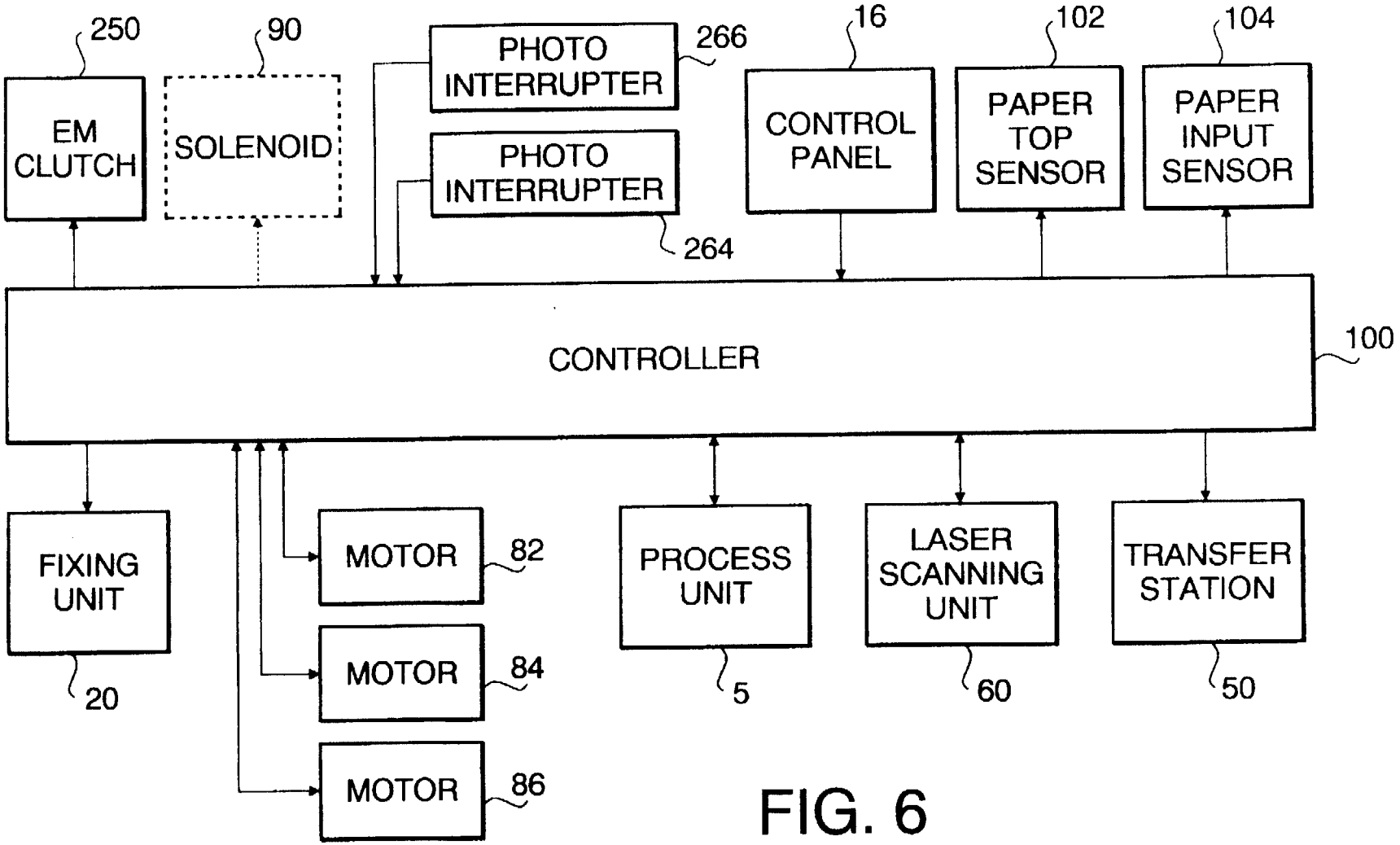
FIG. 6 is a block diagram detailing a control system of the printer.

FIG. 6 is a block diagram detailing the control system of the printer 1. Inputs to the controller 100 include a control panel 16 provided on the exterior of the printer 1, the paper top sensor 102, the paper input sensor 104, and the photointerruptors 266 and 264. The controller 100 controls motors 82, 84, and 86, and an electromagnetic (EM) clutch 250. The controller 100 also controls the fixing unit 20 and the transfer unit 50. Further, the controller 100 controls the elements of the electrophotographic process, including the laser scanning unit 60 and the process unit 5. When the first type of speed control mechanism is used, the controller 100 activates and deactivates the solenoid 90 (shown by a dashed line in FIG. 6).

In order to place a continuous form P into the printer 1, the continuous form P is led in through the inlet 12. The continuous form P is then clamped between the tractor belts 34 and corresponding tractor guide members (not shown) provided in the area of the tractor unit 30. The continuous form P is then advanced, fed only by the tractor 30. Then, when the leading end of the continuous form P reaches the discharge roller pair 40, the continuous form P is nipped and pulled by the discharge roller pair 40, at a speed held constant by tractor 30.

In operation, after a toner image is advanced along the transport path and is fixed at the fixing unit 20, the controller 100 reverses paper transport in order to avoid paper wastage. Specifically, when printing of a page is completed, the tractor unit 30 and the discharge roller pair 40 feed the continuous form P in the forward direction, and stop the form P at a predetermined position where the trailing perforations of the last printed page are discharged from the printer at the outlet 14, to allow the user to view or separate the last printed page. The controller 100 detects the predetermined stopping position according to a paper feed signal generated by an encoder (not shown) linked to the tractor 30.

At this time, an unprinted portion of the form P remains downstream of the image transfer area. However, by reversing the paper transport such that the unprinted portion of the continuous form P is brought upstream of the image transfer area, the unprinted portion is available for printing. In order to reverse the paper transport after the printed pages of the form P are discharged from the printer, the pulley 35 is rotated in a reverse direction to feed the form P in a reverse direction.

The reversing operation of the continuous form P differs when the last printed page is separated and when it is not. For example, if the last printed page is not separated from the form P, the form P is reversed until trailing perforations of the last printed page are upstream of the image transfer area, and the next printing operation is resumed at this point to print a succeeding image on the page next to the last printed page. The paper feed signal is monitored by the controller 1 with reference to the distance from (i) the position to which the trailing edge of the last printed page was advanced, to (ii) the position near the image transfer area at which the printing process is started for each page. When the controller 1 determines the paper top sensor (PTS) 102 is continuously ON as the continuous form P moves from position (i) to position (ii), the last printed page of the continuous form was therefore unseparated, and the page succeeding the last printed page is used as the first page to print the image thereon. In this case, the motor 84 is stopped to stop the reversal of the continuous form P along the transport path. Subsequently, the continuous form P is again fed in the forward feeding direction upon the resumption of printing operations.

Otherwise, the separation of a last printed page is detected when the paper top sensor 102 is turned from ON to OFF before the continuous form moves from position (i) to position (ii). That is, the leading end of the remaining form P is reversed until it is detected by the paper top sensor 102 before the next printing operation is performed. In this case, the motor 84 is stopped, and then rotates to feed the continuous form P in the forward direction, and is driven until the leading edge of the continuous form P is inserted between the discharge roller pair 40. At this time, the page positioned upstream of the transfer area is used as the next page to print an image.

Figure 7A:
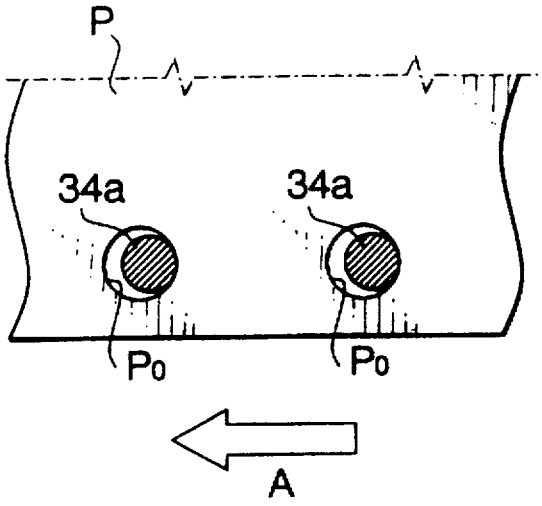
FIG. 7A is a schematic view showing a first engaging condition of feeding holes and pins.
Figure 7B:
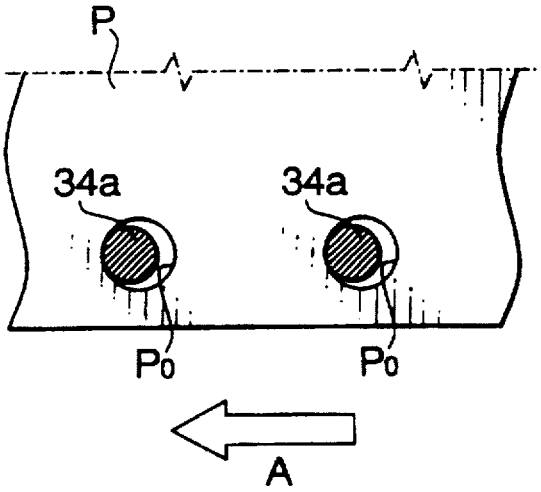
FIG. 7B is a schematic view showing a second engaging condition of feeding holes and pins.

FIGS. 7A and 7B illustrate engaging conditions of the engagement of feeding holes Po of the continuous form P and the pins 34*a* of the tractor belt 34. FIGS. 7A and 7B are not to scale, and the size of the feeding holes Po is exaggerated with reference to the pins 34*a* of the tractor belt. In actuality, the clearance between pins 34*a* and feeding holes Po is less than that shown. In the context of this specification, a "last printed page" is a page which has once passed through the fixing rollers 20, having a fused image printed thereon.

FIG. 7A shows the engaging condition of the feeding holes Po and pins 34*a* during normal forward feeding of the continuous form P. During normal forward feeding of the continuous form P, the fixing rollers 20, which may slip on the surface of the form P, are driven slightly faster than the tractor 30, which is positively engaged with the form P via the pins 34*a*. Accordingly, tension is created between the fixing rollers 20 and tractor 30, and each engaging pin 34*a* abuts the rear surface of a corresponding feeding hole Po, as shown in FIG. 7A. Furthermore, just after a form P is reversed by the tractor 30, but before the continuous form P is again advanced, the continuous form P is in the condition shown in FIG. 7A.

If the passively rotatable pressure roller is moved to contact the continuous form P being fed under tension in the condition shown in FIG. 7A, a delay or backlash is created, and the continuous form P quickly moves from the conditions of FIG. 7A to the condition of FIG. 7B, and back.

Figure 8:
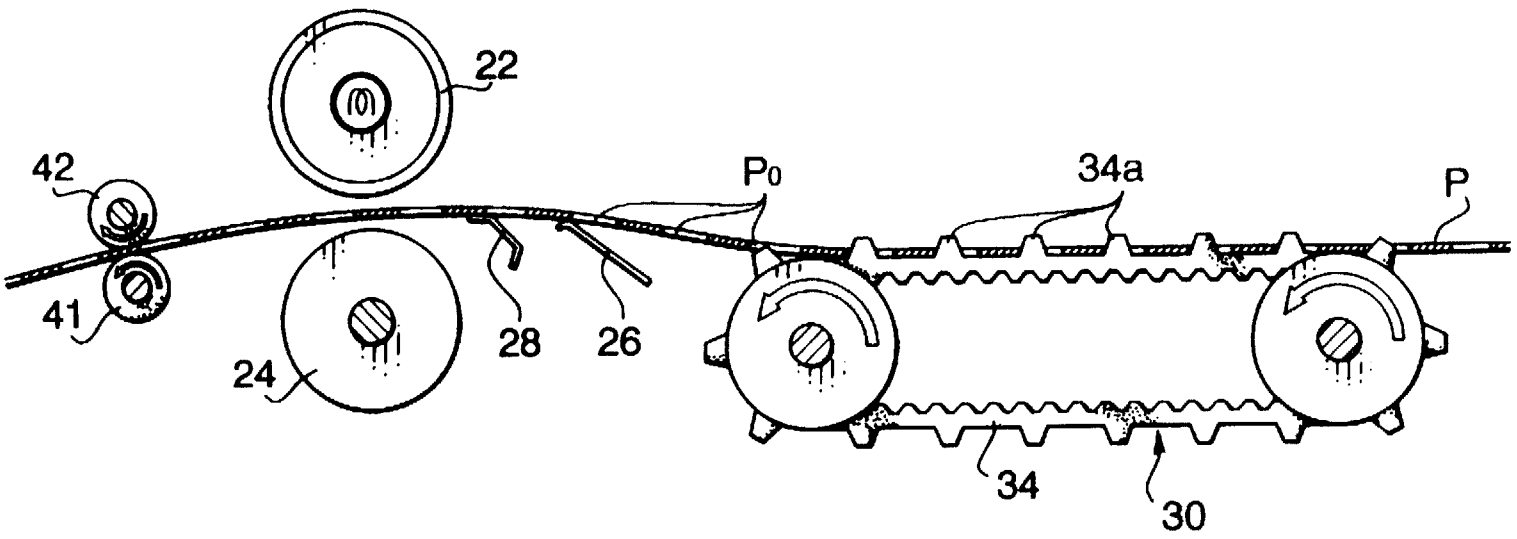
FIG. 8 is a side schematic view of a feeding path of the printer, showing a first embodiment of a form feeding stabilizing device in a first feeding circumstance.

A first embodiment of a form feeding stabilization device is shown in FIGS. 8, 9A through 9G, 10, and 11A through 11G. In FIGS. 8 and 10, the thickness of the continuous form P is greatly exaggerated, so that the relationship between the feeding holes Po of the continuous form P and the pins 34*a* of the tractor belt 34 may be identified. FIGS. 9A through 9G and FIGS. 11A through 11G show the timing of participating devices along the form feeding path, according to the first embodiment of the invention.

The first embodiment of the form feeding stabilizing device moves the pressure roller 24 to its operating position when the continuous form P is slack, i.e., when tension has not yet been applied to the continuous form P by the discharge rollers 20. More specifically, the first embodiment of the form feeding stabilizing device moves the pressure roller 24 to its operating position while the continuous form P is slack, and in an engagement condition substantially as that shown in FIG. 7B. Once the form P is in the condition shown in FIG. 7B, as the circumferential speed difference between the discharge rollers 40 and tractor 30 gradually takes up the clearance between the pins 34*a* and the feeding holes Po, the normal forward feeding condition of FIG. 7A is reached.

There are three feeding circumstances where the continuous form P is slack following a reversing of the continuous form P. That is, the engaging condition shown in FIG. 7B applies to three feeding circumstances. Specifically, a first feeding circumstance to which FIG. 7B applies occurs when a printing operation is started following the reversing of a last printed page and a leading blank page of the continuous form P. In this case, the leading end of the leading blank page is upstream of the fixing rollers 20, but the last printed page of the continuous form P is still attached. Feeding is restarted while the last printed page remains between the fixing rollers 20 and discharge rollers 40, but whiled the rollers are separated from each other. The discharge rollers 40 and pressure rollers 20 are brought from their retracted (separated) condition to an operative condition nipping the continuous form P as the form is fed. Accordingly, after the continuous form P is nipped between the discharge rollers 40, each pin 34a of the tractor belt 34 remains engaging the leading surface of a corresponding feeding hole Po, as shown in FIG. 7B, until the circumferential speed difference between the discharge rollers 40 and tractor 30 gradually takes up the clearance between the pins 34a and the feeding holes Po, and the normal forward feeding condition of FIG. 7A is reached.

A second feeding circumstance to which FIG. 7B applies occurs when a printing operation is started following the separation of a last printed page from the continuous form P, and a reversing of leading end of the continuous form P upstream of the fixing rollers 20. In this case, feeding is restarted while the leading edge of the continuous form is upstream of the fixing rollers 20 and discharge rollers 40. As feeding is carried out by only the tractor 30 until the continuous form P is nipped between the discharge rollers 40, each pin 34a of the tractor belt 34 engages the leading surface of a corresponding feeding hole Po, as shown in FIG. 7B. After the continuous form P is nipped between the discharge rollers 40, the circumferential speed difference between the discharge rollers 40 and tractor 30 gradually takes up the clearance between the pins 34a and the feeding holes Po, until the normal forward feeding condition of FIG. 7A is reached.

A third feeding circumstance to which FIG. 7B applies occurs when a new continuous form P is loaded in the printer 1, or when the form is reloaded after a jam. In this circumstance, since the continuous form P is fed only by the tractor 30 until the continuous form P is nipped between the discharge rollers 40, each pin 34a of the tractor belt 34 engages the front surface of a corresponding feeding hole Po, as shown in FIG. 7B. Again, after the continuous form P is nipped between the discharge rollers 40, the circumferential speed difference between the discharge rollers 40 and tractor 30 gradually takes up the clearance between the pins 34a and the feeding holes Po, until the normal forward feeding condition of FIG. 7A is reached.

FIG. 8 is a side schematic view of the printer 1, showing the first embodiment of a form feeding stabilizing device in the first feeding circumstance after the pressure roller 24 and discharge rollers have been moved to their intermediate positions. That is, as shown in FIG. 8, the form P has been reversed along the feeding path, and has begun feeding in the forward direction. The pressure roller 24 has not contacted the continuous form P, but the upper discharge roller 42 has nipped the form P, and the feeding condition of the feeding holes Po of the continuous form P with respect to the pins 34a of the tractor belt 34 is as illustrated in FIG. 7B. The pins 34a of the tractor belt 34 abut the front surface of corresponding feeding holes Po of the continuous form P.

Figures 9A, 9B, 9C, 9D, 9E, 9F, 9G:
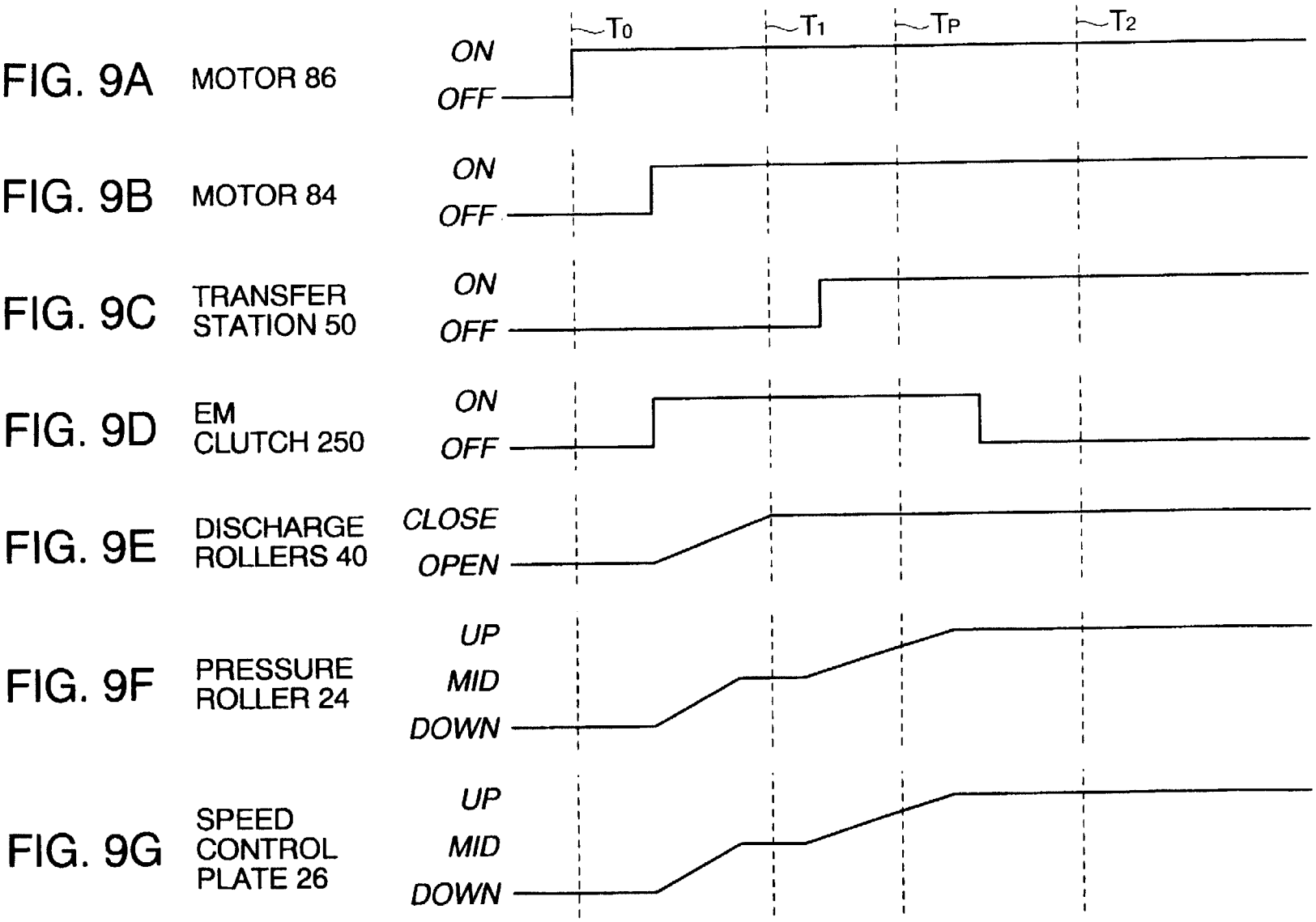
FIG. 9A is a timing chart for a motor for rotating and moving rollers for the first embodiment in the first feeding circumstance.
FIG. 9B is a timing chart for a tractor motor for the first embodiment in the first feeding circumstance.
FIG. 9C is a timing chart for a transfer station for the first embodiment in the first feeding circumstance.
FIG. 9D is a timing chart for an electromagnetic clutch of a roller retraction mechanism for the first embodiment in the first feeding circumstance.
FIG. 9E is a timing chart showing the position of a discharge roller pair for the first embodiment in the first feeding circumstance.
FIG. 9F is a timing chart showing the position of a pressure roller for the first embodiment in the first feeding circumstance.
FIG. 9G is a timing chart showing the position of a speed control plate for the first embodiment in the first feeding circumstance.
Figure 10:
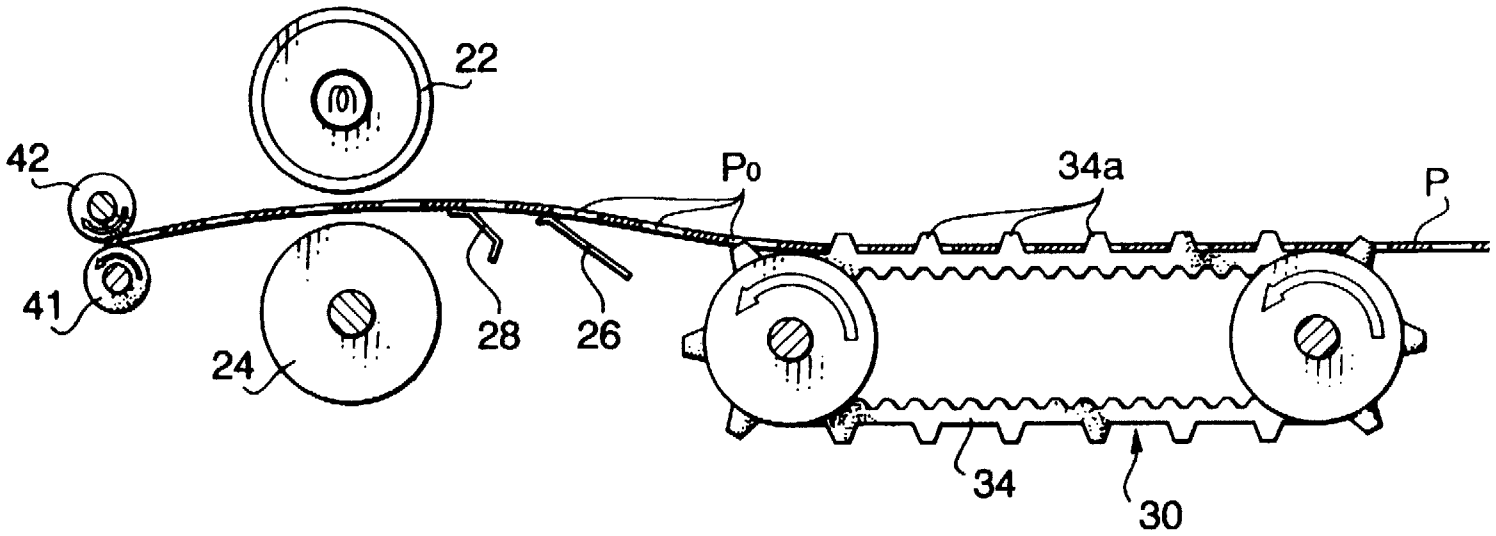
FIG. 10 is a side schematic view of the feeding path of the printer, showing the first embodiment in a second feeding circumstance.

FIGS. 9A through 9G show the timing of the participating elements according to the first embodiment when a last printed page has not been separated. FIG. 9A shows timing for the motor 86, which rotates the heat roller 22 and lower discharge roller 41 when ON; FIG. 9B shows timing for the motor 84, which drives the tractor 30 when ON; FIG. 9C shows timing for the transfer unit 50, which begins the image transfer process when ON; FIG. 9D shows timing for the electromagnetic clutch 250, which engages the roller retraction mechanism when ON to move the pressure roller 24 and upper discharge roller 42; FIG. 9E shows the position of the discharge roller pair 40; FIG. 9F shows the position of the pressure roller; and FIG. 9G shows the position of the speed control plate 26. It should be noted that although FIG. 9G shows the movement of the modified speed control plate 26a according to the rotation of the plate moving cam 261, from the second speed control mechanism previously described, the first embodiment of the invention can alternatively use the first type of speed control mechanism as described. That is, the second speed control plate 26a and plate moving cam 261 can be replaced by the first speed control plate 26a and solenoid 90, with substantially identical timing to that shown in FIG. 9G.

In FIGS. 9A through 9G, T0 marks the initiation of the tractor feeding, T1 marks the initiation of the discharge roller feeding (corresponding to FIGS. 7B and 8), TP marks the approximate time of contact between the pressure roller 24 and continuous form P, and T2 marks the approximate position of the application of tension to the continuous form P as the circumferential speed difference between the discharge rollers 40 and tractor 30 has completed taking up the clearance between the pins 34a and the the feeding holes Po (corresponding to FIG. 7A). The time T2 can be later than shown, depending on the initial slackness in the form P downstream of the tractor 30 following time T1.

As shown in FIGS. 9A through 9G, when the continuous form P is fed, stopped, and resumed, the driving of the tractor 30 is resumed before (or alternatively, simultaneously with) the discharge roller pair 40 close and drive the continuous form P. Furthermore, the pressure roller 24 is moved upwardly to contact the continuous form P before tension is applied between the tractor 30 and discharge roller pair 40.

More specifically, as shown in FIGS. 9A through 9G, the pins 34a of the tractor belt 34 engage the front surfaces of the feeding holes Po of the continuous form just after the tractor 30 is started at time T0. The electromagnetic clutch 250 is then engaged, and the cams 222, 224 rotate to move the discharge roller pair 40 to the closed position and the pressure roller 24 to its operating position. The discharge rollers 40 nip the continuous form P at time T1, and begin to drive the continuous form P at a speed slightly faster than that of the tractor 30.

As the continuous form P is not under tension downstream of the tractor 30 when the pressure roller 24 is moved upwardly, the relationship between the feeding holes Po and the pins 34a of the tractor belt 34 when the pressure roller 24 contacts the form P at time TP is substantially as shown in FIG. 7B. The lack of tension, or slack, is a motion-absorbing region in the continuous form P, absorbing the difference in relative motion between the passively rotatable pressure roller 24 and the continuous form P. Furthermore, the engagement between the pins 34a and the holes Po isolates changes in feeding speed in the motion-absorbing region of the continuous form P from the portion of the continuous form at the image transfer station. Accordingly, when the pressure roller 24 contacts the form P, as the continuous form P is transported by the engagement of the feeding holes Po and the pins 34a of the tractor belt 34 (driven at a constant speed), delay in feeding of the continuous form P on the downstream side of the tractor 30 is not transmitted to the upstream side of the tractor 30. Thereafter, the circumferential speed difference between the discharge rollers 40 and tractor 30 completes taking up the clearance between the pins 34a and the feeding holes Po at time T2, changing the condition of the engagement between the continuous form P and the tractor belt 34 to that shown in FIG. 7A. Changing from the condition shown in FIG. 7B to that in FIG. 7A occurs gradually during feeding of the continuous form P, so that uneven feeding does not occur, and the printing quality is not affected.

FIG. 10 is a side schematic view of the feeding path of the printer, showing the first embodiment of a form feeding stabilizing device in the second and third feeding circumstances after the pressure roller 24 and discharge roller 40s have been moved to their intermediate positions. That is, as shown in FIG. 10, the form P has been reversed along the feeding path until the leading edge is upstream of the fixing rollers 20 (or has been newly inserted in the printer 1), and has begun feeding in the forward direction. The pressure roller 24 has not contacted the continuous form P, and the upper discharge roller 42 is about to nip the form P. The feeding condition of the feeding holes Po of the continuous form P with respect to the pins 34a of the tractor belt 34 is as illustrated in FIG. 7B. The pins 34a of the tractor belt 34 abut the front surface of corresponding feeding holes Po of the continuous form P.

Figures 11A, 11B, 11C, 11D, 11E, 11F, 11G:
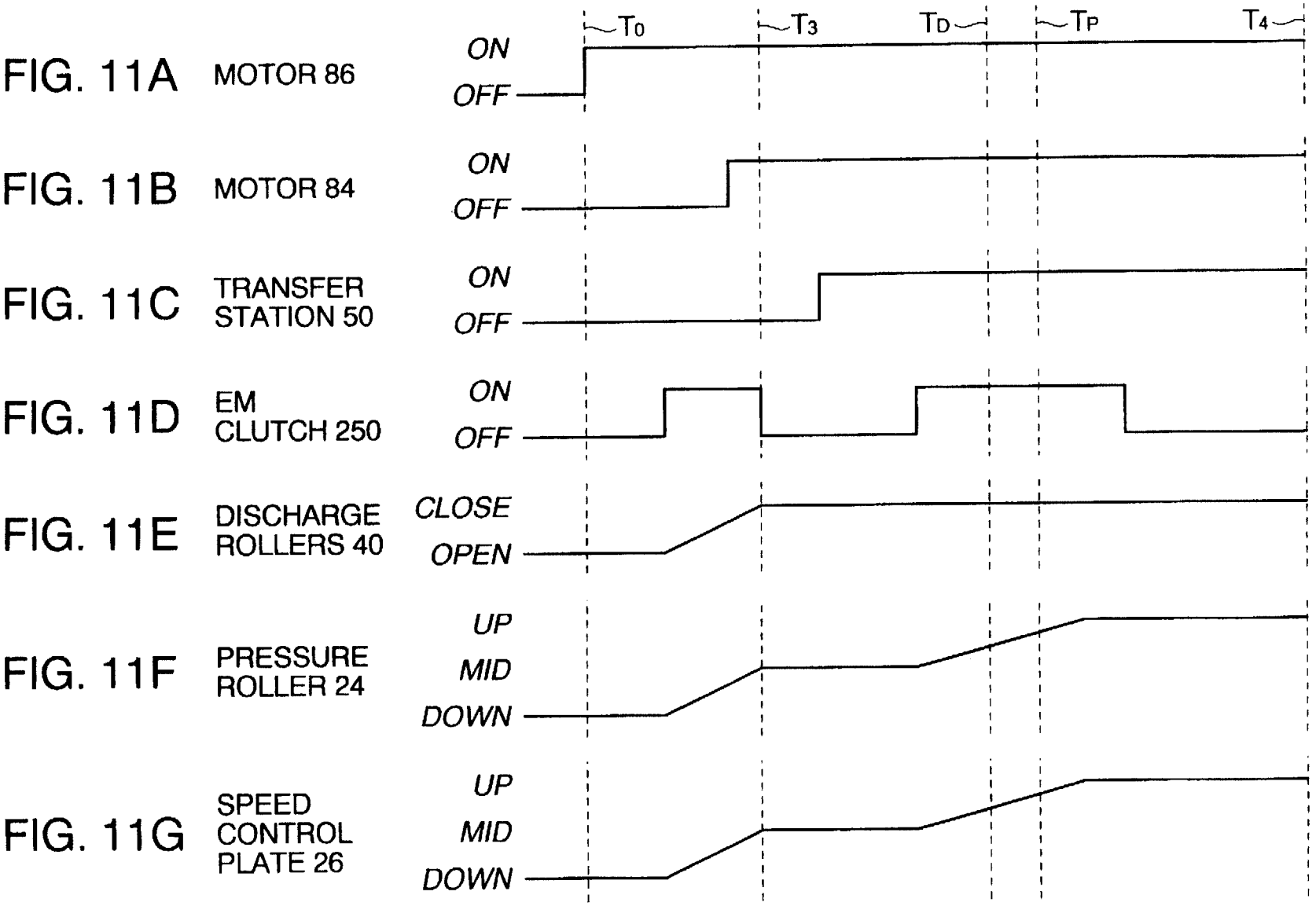
FIGS. 11A through 11G are timing charts corresponding to the timing charts of FIGS. 9A through 9G, respectively, showing the first embodiment in a second feeding circumstance.

FIGS. 11A through 11G show the timing of the participating elements according to the first embodiment when a last printed page has been separated. FIG. 11A shows timing for the motor 86, which rotates the heat roller 22 and lower discharge roller 41 when ON; FIG. 11B shows timing for the motor 84, which drives the tractor 30 when ON; FIG. 11C shows timing for the transfer unit 50, which begins the image transfer process when ON; FIG. 11D shows timing for the electromagnetic clutch 250, which engages the roller retraction mechanism when ON to move the pressure roller 24 and upper discharge roller 42; FIG. 11E shows the position of the discharge roller pair 40; FIG. 11F shows the position of the pressure roller; and FIG. 11G shows the position of the speed control plate 26. It should be noted that although FIG. 11G shows the movement of the modified speed control plate 26a according to the rotation of the plate moving cam 261, from the second speed control mechanism previously described, the first embodiment of the invention can alternatively use the first type of speed control mechanism as described. That is, the second speed control plate 26a and plate moving cam 261 can be replaced by the first speed control plate 26a and solenoid 90, with substantially identical timing to that shown in FIG. 11G.

In FIGS. 11A through 11G, T0 marks the initiation of the tractor feeding, T3 marks the closing of the discharge rollers 40, TD marks the approximate time of that the continuous form P enters the discharge roller 40 nip (corresponding to FIGS. 7B and 10), TP marks the approximate time of contact between the pressure roller 24 and continuous form P, and T4 marks the approximate position of the application of tension to the continuous form P as the circumferential speed difference between the discharge rollers 40 and tractor 30 has completed taking up the clearance between the pins 34a and the feeding holes Po (corresponding to FIG. 7A). The time T4 can be later than shown, depending on the initial slackness in the form P downstream of the tractor 30 following time TD.

As shown in FIGS. 11A through 11G, the driving of the tractor 30 is started before (or alternatively, simultaneously with) the closing of the discharge roller pair 40. Furthermore, the pressure roller 24 is moved upwardly to contact the continuous form P at the same time as the discharge rollers 40 accept the continuous form P and begin to drive the form P, and before tension is applied to the continuous form P between the tractor 30 and discharge roller pair 40.

More specifically, as shown in FIGS. 11A through 11G, the pins 34a of the tractor belt 34 engage the front surfaces of the feeding holes Po of the continuous form just after the tractor 30 is started at time T0. The electromagnetic clutch 250 is then engaged, and the cams 222, 224 rotate to move the discharge roller pair 40 to the closed position and the pressure roller 24 to its intermediate position at time T3. The discharge rollers 40 nip the continuous form P at time TD, and begin to drive the continuous form P at a speed slightly faster than that of the tractor 30.

As the continuous form P is not under tension downstream of the tractor 30 when the pressure roller 24 is moved upwardly, the relationship between the feeding holes Po and the pins 34a of the tractor belt 34 when the pressure roller 24 contacts the form P at time TD is substantially as shown in FIG. 7B. The lack of tension, or slack, is a motion-absorbing region in the continuous form P, absorbing the difference in relative motion between the passively rotatable pressure roller 24 and the continuous form P. Furthermore, the engagement between the pins 34a and the holes Po isolates changes in feeding speed in the motion-absorbing region of the continuous form P from the portion of the continuous form at the image transfer station. Accordingly, when the pressure roller 24 contacts the form P, as the continuous form P is transported by the engagement of the feeding holes Po and the pins 34a of the tractor belt 34 (driven at a constant speed), delay in feeding of the continuous form P on the downstream side of the tractor 30 is not transmitted to the upstream side of the tractor 30. Thereafter, the circumferential speed difference between the discharge rollers 40 and tractor 30 completes taking up the clearance between the pins 34a and the feeding holes Po at time T4, changing the condition of the engagement between the continuous form P and the tractor belt 34 to that shown in FIG. 7A. Changing from the condition shown in FIG. 7B to that in FIG. 7A occurs gradually during feeding of the continuous form P, so that uneven feeding does not occur, and the printing quality is not affected.

FIGS. 12A, 12B, 13A through 13G, 14A, 14B, and 15A through 15G show a second embodiment of a form feeding stabilization device according to the invention. In FIGS. 12A, 12B, 14A, and 14B, the thickness of the continuous form P is greatly exaggerated, so that the relationship between the feeding holes Po of the continuous form P and the pins 34a of the tractor belt 34 may be identified. FIGS. 13A through 13G and FIGS. 15A through 15G show the timing of participating devices along the form feeding path, according to the second embodiment of the invention.

The second embodiment of the form feeding stabilizing device moves the resiliently biased speed control plate 26 into the paper path after the discharge rollers 20 are closed to create a resilient tension in the form P, and then moves the pressure roller 24 to its operating position. More specifically, the second embodiment of the form feeding stabilizing device moves the pressure roller 24 to its operating position in the condition shown in FIG. 7A, but while the speed control plate 26 is able to resiliently absorb any delay or backlash in feeding. The normal forward feeding condition of FIG. 7A is reached as soon as the speed control plate 26 is brought into the feeding path.

Figure 12A:
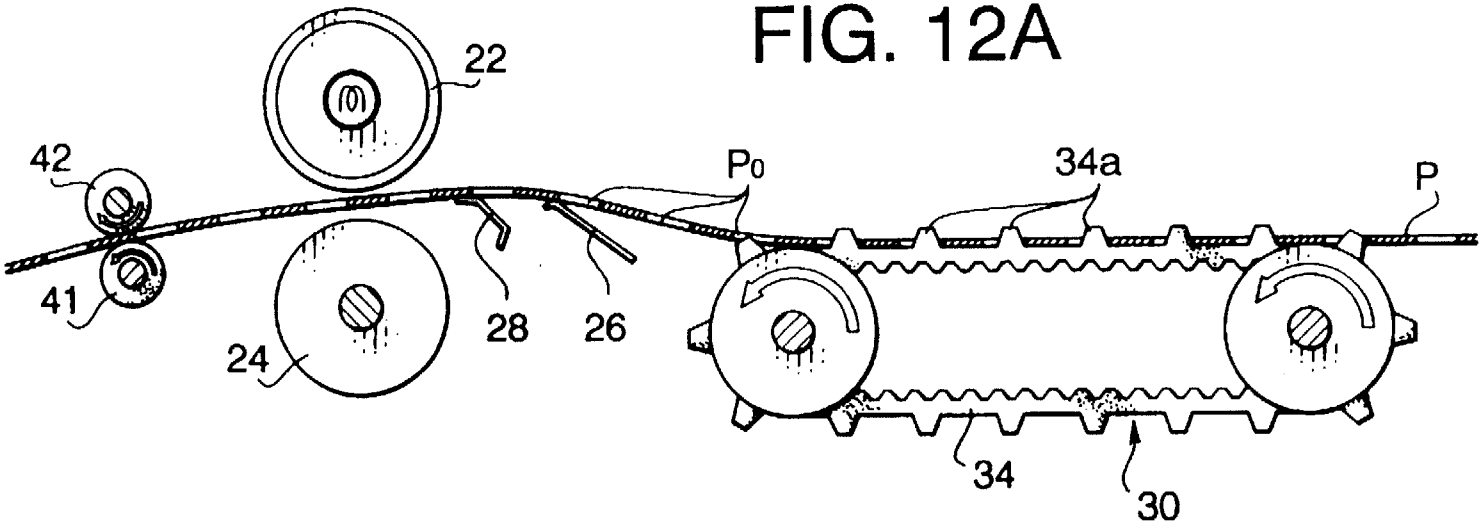
FIGS. 12A and 12B are side schematic views of the feeding path of a second embodiment of the form feeding stabilizing device in a first feeding circumstance.
Figure 12B:
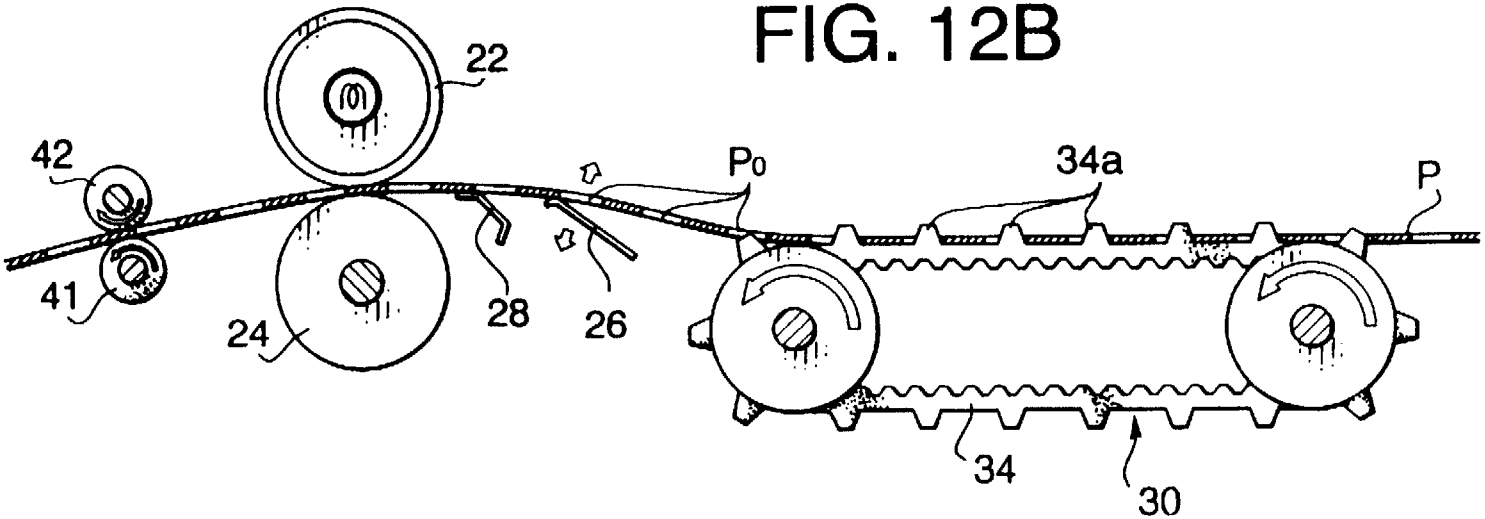

FIGS. 12A and 12B are side schematic views of the printer 1, illustrating the second embodiment of the form feeding stabilizing device in the circumstance where the last printed page of a form has not been separated. In FIGS. 12A and 12B, the form P has been reversed along the feeding path, and has begun feeding in the forward direction, while a portion of the form P remains between the fixing rollers 20 and between the discharge rollers 40. Firstly, as shown in FIG. 12A, the pressure roller 24 has not contacted the continuous form P, but the upper discharge roller 42 has nipped the form P, and the speed control plate 26 has been moved into a position to contact the continuous form P. At this point, the speed control plate 26 is between levels L3 and L4 as previously described. The feeding condition of the feeding holes Po of the continuous form P with respect to the pins 34*a* of the tractor belt 34 is as illustrated in FIG. 7A, but the continuous form P is resiliently biased by the speed control plate 26. The pins 34*a* of the tractor belt 34 abut the rear surface of corresponding feeding holes Po of the continuous form P.

As the pressure roller 24 is moved to its operating position, shown in FIG. 12B, even if a delay or backlash is caused in the feeding of the continuous form P between the fixing rollers 20 and the tractor 30, the delay or backlash is absorbed by the resiliency the speed control plate 26. As the engaging condition of the continuous form P with respect to the tractor remains as shown in FIG. 7A, the delay or backlash is not transmitted upstream.

Figures 13A, 13B, 13C, 13D, 13E, 13F, 13G:
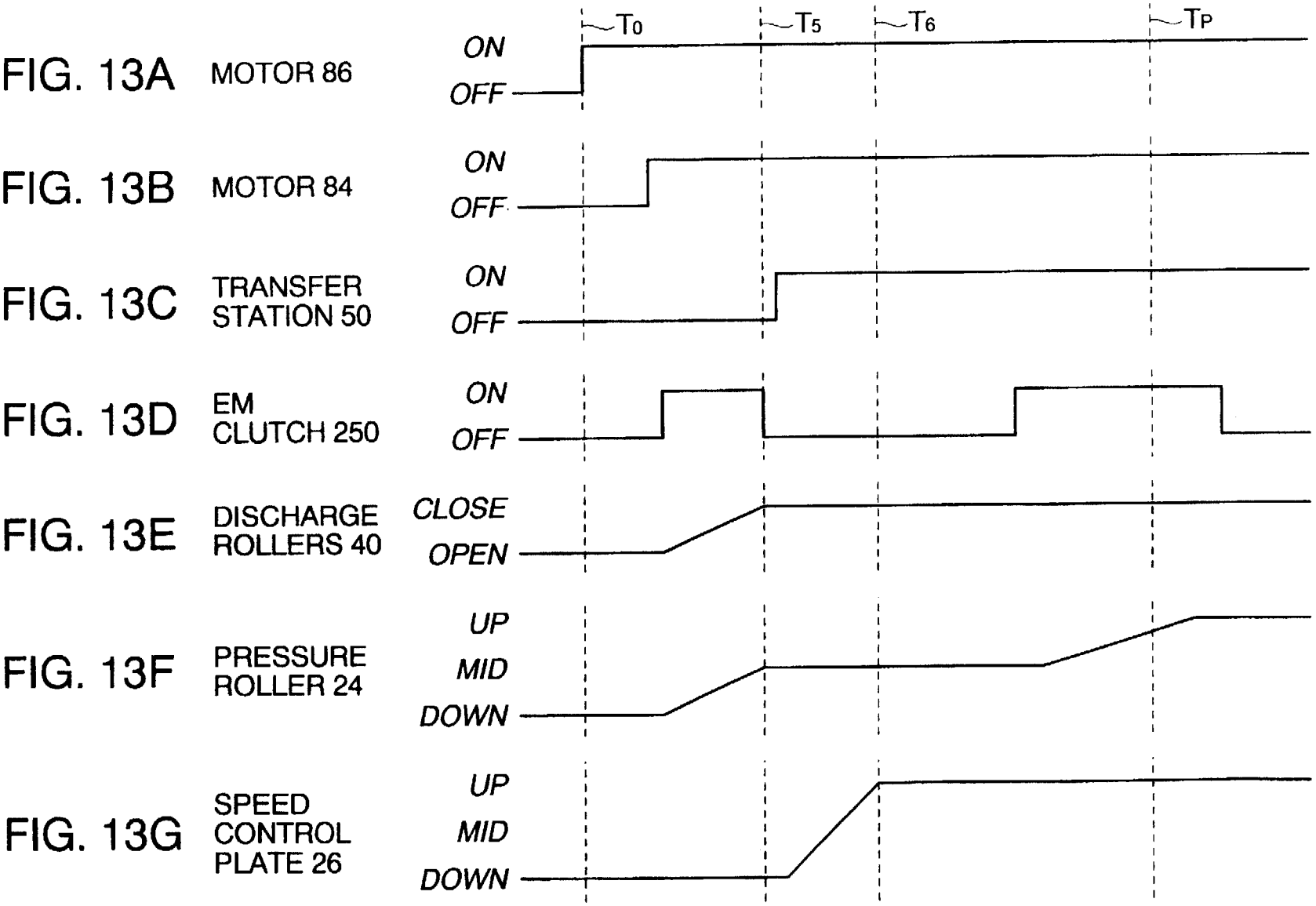
FIG. 13A is a timing chart for a motor for rotating and moving rollers for the second embodiment in the first feeding circumstance.
FIG. 13B is a timing chart for a tractor motor for the second embodiment in the first feeding circumstance.
FIG. 13C is a timing chart for a transfer station for the second embodiment in the first feeding circumstance.
FIG. 13D is a timing chart for an electromagnetic clutch of a roller retraction mechanism for the second embodiment in the first feeding circumstance.
FIG. 13E is a timing chart showing the position of a discharge roller pair for the second embodiment in the first feeding circumstance.
FIG. 13F is a timing chart showing the position of a pressure roller for the second embodiment in the first feeding circumstance.
FIG. 13G is a timing chart showing the position of a speed control plate for the second embodiment in the first feeding circumstance.

FIGS. 13A through 13G show the timing of the participating elements according to the second embodiment when a last printed page has not been separated. FIG. 13A shows timing for the motor 86, when rotates the heat roller 22 and lower discharge roller 41 when ON; FIG. 13B shows timing for the motor 84, which drives the tractor 30 when ON; FIG. 13C shows timing for the transfer unit 50, which begins the image transfer process when ON; FIG. 13D shows timing for the electromagnetic clutch 250, which engages the roller retraction mechanism when ON to move the pressure roller 24 and upper discharge roller 42; FIG. 13E shows the position of the discharge roller pair 40; FIG. 13F shows the position of the pressure roller; and FIG. 13G shows the position of the speed control plate 26. It should be noted that although FIG. 13G shows the movement of the speed control plate 26 according to the actuation of the solenoid 90, from the first speed control mechanism previously described, the second embodiment of the invention can alternatively use the second type of speed control mechanism as described. That is, the first speed control plate 26*a* and solenoid 90 can be replaced by the second speed control plate 26 and a plate moving cam 261 having a shape to generate substantially identical timing to that shown in FIG. 13G.

In FIGS. 13A through 13G, T0 marks the initiation of the tractor feeding, T5 marks the initiation of the discharge roller feeding (corresponding to FIGS. 7B and 8), T6 marks the application of the speed control plate 26 to the continuous form P and the approximate position of the application of resilient tension to the continuous form P, and TP marks the approximate time of contact between the pressure roller 24 and continuous form P.

As shown in FIGS. 13A through 13G, when the continuous form P is fed, stopped, and resumed, the driving of the tractor 30 is resumed before (or alternatively, simultaneously with) the discharge roller pair 40 close and drive the continuous form P. Furthermore, the pressure roller 24 is moved upwardly to contact the continuous form P after a resilient tension is applied between the tractor 30 and discharge roller pair 40.

More specifically, as shown in FIGS. 13A through 13G, the pins 34*a* of the tractor belt 34 engage the front surfaces of the feeding holes Po of the continuous form just after the tractor 30 is started at time T0. The electromagnetic clutch 250 is then engaged, and the cams 222, 224 rotate to move the discharge roller pair 40 to the closed position and the pressure roller 24 to its intermediate position, whereupon the electromagnetic clutch 250 is disengaged. The discharge rollers 40 nip the continuous form P at time T5, and begin to drive the continuous form P at a speed slightly faster than that of the tractor 30.

Subsequently, the solenoid 90 is activated, and the speed control plate 26 is moved into the form feeding path at time T6. The feeding condition of the continuous form P with respect to the tractor belt 34 becomes as shown in FIG. 7A, and the continuous form P is placed under a resilient tension by the resiliently movable speed control plate 26 (corresponding to FIG. 12A).

After time T6, the electromagnetic clutch 250 is reactivated, and the pressure roller 24 is moved by the cams 222, 224 to the operative position. As the continuous form P is under a resilient tension downstream of the tractor 30 when the pressure roller 24 is moved upwardly, the relationship between the feeding holes Po and the pins 34*a* of the tractor belt 34 when the pressure roller 24 contacts the form P at time TP is substantially as shown in FIG. 7A. At this time the speed control plate 26 is positioned between the levels L3 and L4 as previously described. The resilient portion (under the resilient bias of the speed control plate 26) of the continuous form P is a motion-absorbing region in the continuous form P, absorbing the difference in relative motion between the passively rotatable pressure roller 24 and the continuous form P. Furthermore, the engagement between the pins 34*a* and the holes Po isolates changes in feeding speed in the motion-absorbing region of the continuous form P from the portion of the continuous form at the image transfer station. Accordingly, when the pressure roller 24 contacts the form P, as the continuous form P is resiliently biased to absorb backlash or delay by a swinging movement of the speed control plate 26, delay in feeding of the continuous form P on the downstream side of the tractor 30 is not transmitted to the upstream side of the tractor 30. Thereafter, the feeding of the continuous form P continues in the condition shown in FIG. 7A (corresponding to FIG. 12B).

Figure 14A:
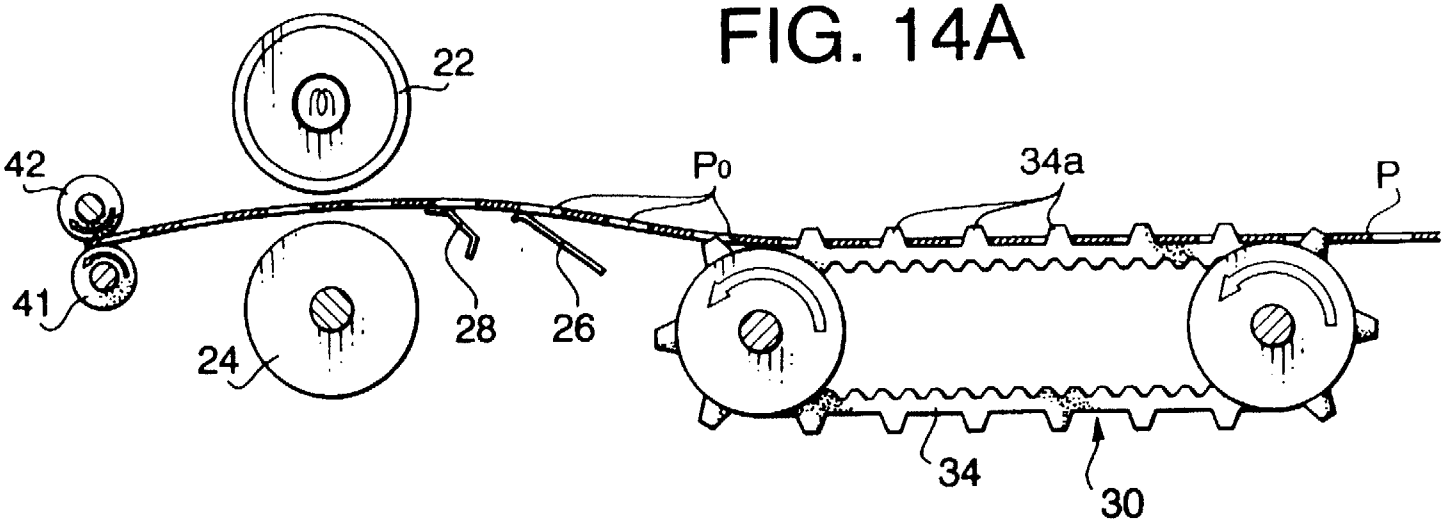
FIGS. 14A and 14B are side schematic views of the feeding path of a second embodiment of the form feeding stabilizing device in a second feeding circumstance.
Figure 14B:
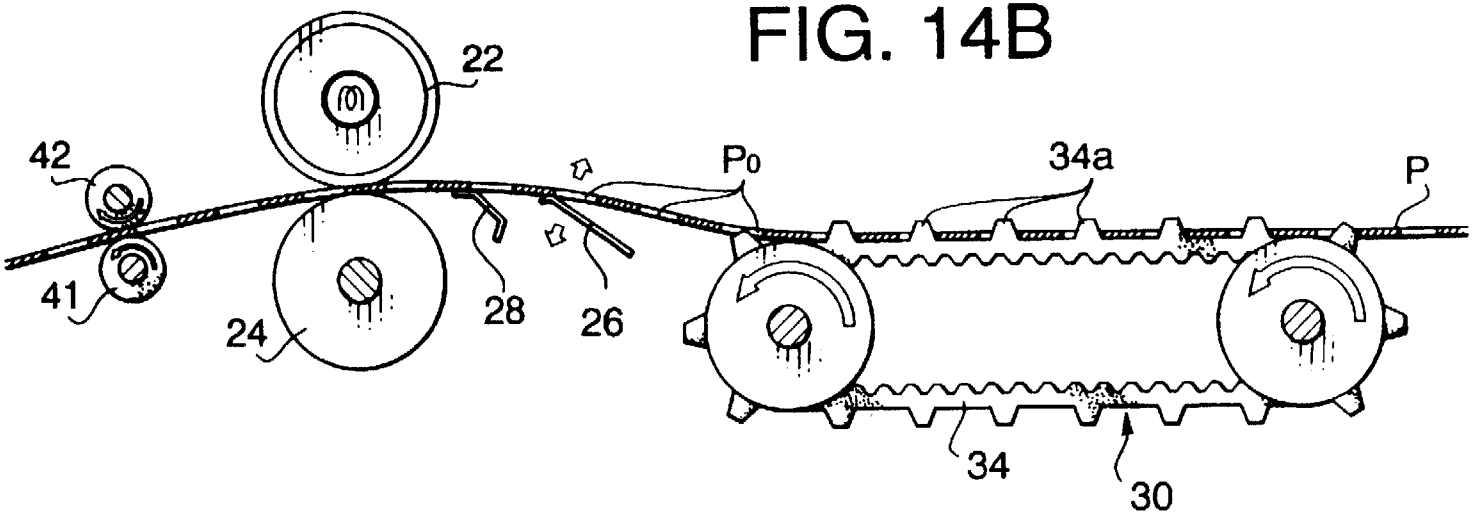

FIGS. 14A and 14B are side schematic views of the printer 1, illustrated the second embodiment of the form feeding stabilizing device in the circumstance where the last printed page of a form has been separated. In FIGS. 14A and 14B, the form P has been reversed along the feeding path until the leading edge is upstream of the fixing rollers 20 (or has been newly inserted in the printer 1), and has begun feeding in the forward direction. Firstly, as shown in FIG. 14A, the pressure roller 24 has not contacted the continuous form P, and the upper discharge roller 42 is about to nip the form P, while the speed control plate 26 has been moved into a position to contact the continuous form P. At this point, the speed control plate 26 is between levels L3 to L4 as previously described. The feeding condition of the feeding holes Po of the continuous form P with respect to the pins 34*a* of the tractor belt 34 is as illustrated in FIG. 7A, but the continuous form P is resiliently biased by the speed control plate. The pins 34*a* of the tractor belt 34 abut the rear surface of corresponding feeding holes Po of the continuous form P.

As the pressure roller 24 is moved to its operating position, shown in FIG. 14B, even if a delay or backlash is caused in the feeding of the continuous form P between the fixing rollers 20 and the tractor 30, the delay or backlash is absorbed by the resiliency the speed control plate 26. As the engaging condition of the continuous form P with respect to the tractor remains as shown in FIG. 7A, the delay or backlash is not transmitted upstream.

Figures 15A, 15B, 15C, 15D, 15E, 15F, 15G:
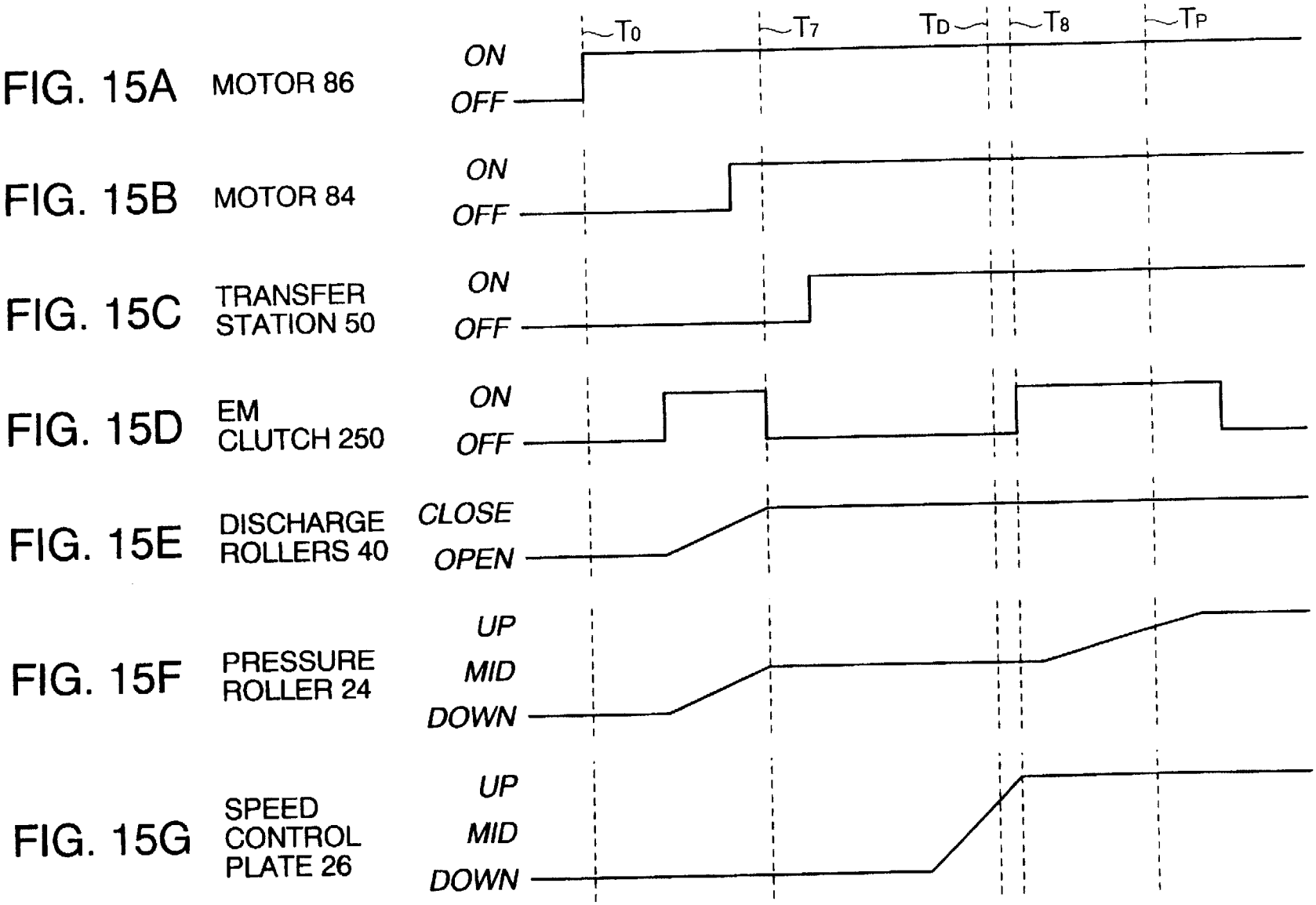
FIGS. 15A through 15G are timing charts corresponding to the timing charts of FIGS. 13A through 13G, respectively, showing the second embodiment in the second feeding circumstance.

FIGS. 15A through 15G show the timing of the participating elements according to the second embodiment when a last printed page has been separated. FIG. 15A shows timing for the motor 86, which rotates the heat roller 22 and lower discharge roller 41 when ON; FIG. 15B shows the timing for the motor 84, which drives the tractor 30 when ON; FIG. 15C shows the timing for the transfer unit 50, which begins the image transfer process when ON; FIG.

15D shows timing for the electromagnetic clutch 250, which engages the roller retraction mechanism when ON to move the pressure roller 24 and upper discharge roller 42; FIG. 15E shows the position of the discharge roller pair 40; FIG. 15F shows the position of the pressure roller; and the FIG. 15G shows the position of the speed control plate 26. It should be noted that although FIG. 15G shows the movement of the speed control plate 26 according to the actuation of the solenoid 90, from the first speed control mechanism previously described, the second embodiment of the invention can alternatively use the second type of speed control mechanism as described. That is, the first speed control plate 26 and solenoid 90 can be replaced by the second speed control plate **26*a* and a plate moving cam 261 having a shape to generate substantially identical timing to that shown in FIG. 15G**.

In FIGS. 15A through 15G, T0 marks the initiation of the tractor feeding, T7 marks the completion of the discharge rollers 40 closing, TD marks the approximate time of that the continuous form P enters the discharge roller 40 nip, T8 marks the application of the speed control plate 26 to the continuous form P and the approximate position the application of resilient tension to the continuous form P (corresponding to FIGS. 7A and 14A), and TP marks the approximate time of contact between the pressure roller 24 and continuous form.

As shown in FIGS. 15A through 15G, when the continuous form P is fed, stopped, and the resumed, the driving of the tractor 30 is resumed before the closing of the discharge roller pair 40, while a resilient tension is applied to the continuous form P by the speed control plate 26 just after, or at substantially the same time, as the discharge rollers 40 nip and begin driving the continuous sheet. Furthermore, the pressure roller 24 is moved upwardly to contact the continuous form P after a resilient tension is applied between the tractor 30 and discharge roller pair 40.

More specifically, as shown in FIGS. 15A through 15G, the pins **34*a* of the tractor belt 34 engage the front surfaces of the feeding holes Po of the continuous form just after the tractor 30 is started at time T0. The electromagnetic clutch 250 is then engaged, and the cams 222, 224 rotate to move the discharge roller pair 40 to the closed position and the pressure roller 24 to its intermediate position at time T7, whereupon the electromagnetic clutch 250 is disengaged. The discharge rollers 40 nip the continuous form P at time TD, and begin to drive the continuous form P at a speed slightly faster than that of the tractor 30**.

Subsequently, the solenoid 90 is activated, and the speed control plate 26 is moved into the form feeding path at time T8. The feeding condition of the continuous form P with respect to the tractor belt 34 becomes as shown in FIG. 7A, and the continuous form P is placed under a resilient tension by the resiliently movable speed control plate 26 (corresponding to FIG. 14A).

After time T8, the electromagnetic clutch 250 is reactivated, and the pressure roller 24 is moved by the cams 222, 224 to the operative position. As the continuous form P is under a resilient tension downstream of the tractor 30 when the pressure roller 24 is moved upwardly, the relationship between the feeding holes Po and the pins **34*a* of the tractor belt 34 when the pressure roller 24 contacts the form P at time TP is substantially as shown in FIG. 7A. At this time the speed control plate 26 is positioned between the levels L3 and L4 as previously described. The resilient portion (under the resilient bias of the speed control plate 26) of the continuous form P is a motion-absorbing region in the continuous form P, absorbing the difference in relative motion between the passively rotatable pressure roller 24 and the continuous form P. Furthermore, the engagement between the pins 34*a* and the holes Po isolates changes in feeding speed in the motion-absorbing region of the continuous form P from the portion of the continuous form at the image transfer station. Accordingly, when the pressure roller 24 contacts the form P, as the continuous form P is resiliently biased to absorb backlash or delay by a swinging movement of the speed control plate 26, delay in feeding of the tractor 30 is not transmitted to the upstream side of the tractor 30. In order to efficiently use the blank portions of the form P, the pressure roller 24 is closed as soon as possible after the position of the speed control plate 26 is stable between levels L3 and L4 as previously described. Thereafter, the feeding of the continuous form P continues in the condition shown in FIG. 7A (corresponding to FIG. 14B**).

Thus, according to the invention, since a motion-absorbing region is formed in the continuous form to absorb a difference in relative motion between said moving roller and the continuous form, the temporary delay of the feeding of the continuous form P due to a returning movement of the fixing roller does not influence the feeding of the continuous form upstream of the tractor or in the transfer region, so that even during the initial period of the printing operation, printing quality is stable.

The present disclosure relates to subject matter contained in Japanese Patent Application No. HEI 07-091258, filed on Mar. 25, 1995, which is expressly incorporated herein by reference in its entirety.

What is claimed is:

1. A form feeding stabilization device for a continuous form electrophotographic printer, said device comprising:

a first form feeder for feeding the continuous form at a constant speed along a form feeding path;

an image transfer station along said form feeding path, for transferring a toner image to the continuous form;

fixing rollers along said form feeding path, for fixing the toner image by applying heat and pressure to the toner image, at least one of said fixing rollers being a movable roller movable into and out of contact with the continuous form along said form feeding path downstream of said first form feeder;

a roller moving mechanism for moving said movable roller into and out of contact with the continuous form;

means for forming a motion-absorbing region in the continuous form to absorb a difference in relative motion between said moving roller and the continuous form; and tensioning means for applying tension to the continuous form in said motion-absorbing region, said tensioning means including a pair of discharge rollers for feeding the continuous form, said discharge rollers being downstream of said fixing rollers along said feeding path;

said forming means comprising control means for controlling said tensioning means to apply tension to the continuous form after said first form feeder feeds the continuous form at a constant speed and after said roller moving mechanism moves said movable roller into contact with the continuous form.

2. The form feeding stabilization device according to claim 1, one of said fixing rollers being a heat roller, and said movable roller being a passively rotatable pressure roller for pressing the continuous form against said heat roller.

3. The form feeding stabilization device according to claim 1, said roller moving mechanism comprising:

a cam follower connected to said passively rotatable roller;

a cam for moving said cam follower; and a motor for moving said cam, said motor being controlled by said control means.

4. The form feeding stabilization device according to claim 1, further comprising:

means for engaging the continuous form to isolate said motion-absorbing region of the continuous form from said form feeding path at said image transfer means.

5. The form feeding stabilization device according to claim 4, said means for engaging the continuous form comprising:

a tractor belt for engaging sprocket holes formed in the continuous form.

6. The form feeding stabilization device according to claim 1, said tensioning means further comprising:

a movable speed control plate contacting the continuous form;

sensors for sensing a position of said movable speed control plate; and control means for controlling a driving speed of said discharge rollers according to a position of said movable speed control plate.

7. The form feeding stabilization device according to claim 6, said discharge rollers rotating at a higher surface circumferential speed than said first form feeder.

8. The form feeding stabilization device according to claim 1, said control means including means for controlling said image transfer station to begin transferring the toner image to the continuous form after said motion-absorbing region is formed in the continuous form and before said roller moving means moves said movable roller into contact with the continuous form.

9. A form feeding stabilization device for a continuous form electrophotographic printer, said device comprising:

first feeding means for feeding a continuous form at a constant speed along a feeding path;

means for forming a motion-absorbing region downstream of said first feeding means along said feeding path;

image transfer means for transferring a toner image to the continuous form;

roller moving means for moving a passively rotatable roller into contact with the continuous form downstream of said first feeding means;

tensioning means for applying tension to the continuous form in said motion-absorbing region;

said forming means comprising control means for controlling said tensioning means to apply tension to the continuous form after said first feeding means feeds the continuous form at a constant speed and after said roller moving means moves said passively rotatable roller into contact with the continuous form; and fixing means for fixing the toner image on the continuous form.

10. The form feeding stabilization device according to claim 9, further comprising a heat roller, and wherein said passively rotatable roller is a pressure roller for pressing the continuous form against said heat roller.

11. The form feeding stabilization device according to claim 9, said roller moving means comprising:

a cam follower connected to the passively rotatable roller;

a cam for moving said cam follower; and a motor for moving said cam, said motor being controlled by said control means.

12. The form feeding stabilization device according to claim 9, said tensioning means comprising:

a pair of driven discharge rollers for applying tension to said continuous form rollers downstream of said fixing means.

13. The form feeding stabilization device according to claim 12, said tensioning means further comprising:

a movable speed control plate contacting said continuous form;

sensors for sensing a position of said movable speed control plate; and control means for controlling a driving speed of said discharge rollers according to a position of said movable speed control plate.

14. The form feeding stabilization device according to claim 9, said control means including means for controlling said image transfer means to begin transferring the toner image to the continuous form after said motion-absorbing region is formed in the continuous form and before said roller moving means moves said passively rotatable roller into contact with the continuous form.

15. The form feeding stabilization device according to claim 9, further comprising:

means for removing changes in feeding speed in said motion-absorbing region of the continuous form.

16. The form feeding stabilization device according to claim 15, said means for removing changes in feeding speed comprising:

second feeding means for feeding the continuous form arranged downstream of said means for fixing, said second means for feeding the continuous form urging said form at a higher feeding speed than said first means for feeding.

17. The form feeding stabilization device according to claim 16, said second feeding means comprising a pair of driven rollers, and said first feeding means comprising a tractor.

18. The form feeding stabilization device according to claim 9, further comprising:

means for isolating changes in feeding speed in said motion-absorbing region of the continuous form from a portion of the continuous form at which said toner image is transferred.

19. The form feeding stabilization device according to claim 18, said means for isolating changes in feeding speed comprising:

a tractor belt for engaging sprocket holes formed in the continuous form.

20. A form feeding stabilization device for a continuous form electrophotographic printer, said device comprising:

a first form feeder for feeding the continuous form at a constant speed along a form feeding path;

an image transfer station along said form feeding path, for transferring a toner image to the continuous form;

fixing rollers along said form feeding path, for fixing the toner image by applying heat and pressure to the toner image, at least one of said fixing rollers being a movable roller movable into and out of contact with the continuous form along said form feeding path downstream of said first form feeder;

a roller moving mechanism for moving said movable roller into and out of contact with the continuous form;

means for forming a motion-absorbing region in the continuous form to absorb a difference in relative motion between said moving roller and the continuous form;

tensioning means for applying tension to the continuous form in said motion-absorbing region, said tensioning means including a pair of discharge rollers for feeding the continuous form, said discharge rollers being downstream of said fixing rollers along said feeding path; and said forming means comprising control means for controlling said tensioning means to apply tension to the continuous form after said first feeding means feeds the continuous form at a constant speed and after said roller moving means moves said passively rotatable roller into contact with the continuous form.

21. The form feeding stabilization device according to claim 20, said control means including means for controlling said image transfer station to begin transferring said toner image to said continuous form before said roller moving mechanism moves said movable roller into contact with the continuous form.

22. The form feeding stabilization device according to claim 20, said biasing means comprising:

a speed control plate for contacting the continuous form;

a resilient member connected to said speed control plate, said resilient member resiliently responsive to movement of said speed control plate; and a mechanism for moving said speed control plate into contact with the continuous form.

23. The form feeding stabilization device according to claim 22, said mechanism for moving said speed control plate into contact with the continuous form comprising:

a solenoid connected to said speed control plate and control means by said control means.

24. The form feeding stabilization device according to claim 22, said mechanism for moving said speed control plate into contact with the continuous form comprising:

a cam follower connected to said speed control plate;

a cam for moving said cam follower; and a motor for moving said cam, said motor being controlled by said control means.

25. The form feeding stabilization device according to claim 20, one of said fixing rollers being a heat roller, said movable roller being a passively rotatable pressure roller for pressing the continuous form against said heat roller.

26. The form feeding stabilization device according to claim 20, said roller moving mechanism comprising:

a cam follower connected to said movable roller;

a cam for moving said cam follower; and a motor for moving said cam, said motor being controlled by said control means.

27. A form feeding stabilization device according to claim 20, further comprising a tractor belt for engaging sprocket holes in the continuous form.

28. A form feeding stabilization device for a continuous form electrophotographic printer, said device comprising:

first feeding means for feeding a continuous form at a constant speed along a feeding path;

means for forming a motion-absorbing region downstream of said first feeding means along said feeding path, image transfer means for transferring a toner image to the continuous form;

roller moving means for moving a passively rotatable roller into contact with the continuous form downstream of said first feeding means;

tensioning means for applying tension to the continuous form in said motion-absorbing region;

said forming means comprising biasing means for resiliently biasing the continuous form and control means for controlling said biasing means to resiliently bias the continuous form after said first feeding means feeds the continuous form at a constant speed, before said tensioning means applies tension to the continuous form, and before said roller moving means moves said passively rotatable roller into contact with the continuous form; and fixing means for fixing the toner image on the continuous form.

29. The form feeding stabilization device according to claim 28, said control means including means for controlling said image transfer means to begin transferring said toner image to the continuous form before said roller moving means moves said passively rotatable roller into contact with the continuous form.

30. The form feeding stabilization device according to claim 28, said biasing means comprising:

a speed control plate for contacting the continuous form;

a resilient member connected to said speed control plate, said resilient member resiliently responsive to movements of said speed control plate; and a mechanism for moving said speed control plate into contact with the continuous form.

31. The form feeding stabilization device according to claim 30, said mechanism for moving said speed control plate into contact with the continuous form comprising:

a solenoid connected to said speed control plate and control means by said control means.

32. The form feeding stabilization device according to claim 30, said mechanism for moving said speed control plate into contact with said continuous form comprising:

a cam follower connected to said speed control plate;

a cam for moving said cam follower; and a motor for moving said cam, said motor being controlled by said control means.

33. A form feeding stabilization device according to claim 28, further comprising means for removing changes in feeding speed in said motion absorbing region of the continuous form.

34. The form feeding stabilization device according to claim 33, said means for removing changes in feeding speed comprising second feeding means for feeding the continuous form, said second feeding means positioned downstream of said fixing means, said second feeding means comprising a pair of driven rollers, said first feeding means comprising a tractor.

* * * * *

UNITED STATES PATENT AND TRADEMARK OFFICE

CERTIFICATE OF CORRECTION

PATENT NO. : 5,785,440

DATED : July 28, 1998

INVENTOR(S) : Tomoyuki NISHIKAWA et al.

It is certified that error appears in the above-identified patent and that said Letters Patent is hereby corrected as shown below:

column 2, line 53 change "to" to ---with---.

column 3, line 9 change "to" to ---with---.

column 3, line 53 delete "and".

at column 4, line 64 delete "a".

at column 11, line 33 change "and" to ---from---.

at column 12, line 52 change "reversing" to ---reversal---.

at column 12, line 54 after "applies" insert ---,---.

at column 12, line 56 change "reversing" to ---reversal---.

at column 13, line 11 change "reversing" to ---reversal---.

at column 13, line 11 after "of" (first occurrence) insert ---the---.

at column 13, line 25 after "applies" insert ---,---.

at column 13, line 58 after "shows" insert ---the---.

at column 13, line 61 after "and" insert ---the---.

UNITED STATES PATENT AND TRADEMARK OFFICE

CERTIFICATE OF CORRECTION

PATENT NO. : 5,785,440

DATED : July 28, 1998

INVENTOR(S) : Tomoyuki NISHIKAWA et al.

It is certified that error appears in the above-identified patent and that said Letters Patent is hereby corrected as shown below:

at column 14, line 11
after "and" insert ---the---.

at column 14, line 14
after "and" insert ---the---.

at column 14, line 23
change "close" to ---closing---.

at column 14, line 23
change "drive" to ---driving---.

at column 14, line 38
change "As" to ---Since---.

at column 15, line 2
change "roller 40s" to ---rollers 40---.

at column 15, line 24
after "ON" insert ---,---.

at column 15, line 40
delete "of".

at column 15, line 56
change "as" to ---that---.

at column 16, line 7
after "34" (second occurrence) insert ---,---.

at column 16, line 8
after "TD" insert ---,---.

at column 17, line 11
after "resiliency" insert ---of---.

at column 17, line 16
after "embodiment" insert ---,---.

UNITED STATES PATENT AND TRADEMARK OFFICE

CERTIFICATE OF CORRECTION

PATENT NO. : 5,785,440

DATED : July 28, 1998

INVENTOR(S) : Tomoyuki NISHIKAWA et al.

It is certified that error appears in the above-identified patent and that said Letters Patent is hereby corrected as shown below:

at column 17, line 17
after "shows" insert ---the---.

at column 17, line 19
after "shows" insert ---the---.

at column 17, line 22
after "shows" insert ---the---.

at column 17, line 25
after "shows" insert ---the---.

at column 17, line 50
change "close" to ---closing---.

at column 17, line 50
change "drive" to ---driving---.

at column 18, line 63
after "shows" insert ---the---.

at column 19, line 1
after "shows" insert ---the---.

at column 19, line 19
delete "of".

UNITED STATES PATENT AND TRADEMARK OFFICE

CERTIFICATE OF CORRECTION

PATENT NO. : 5,785,440

DATED : July 28, 1998

INVENTOR(S) : Tomoyuki NISHIKAWA et al.

It is certified that error appears in the above-identified patent and that said Letters Patent is hereby corrected as shown below:

at column 19, line 26
after "and" insert ---the---.

at column 19, line 35
after "P" insert ---,---.

at column 20, line 20
change "said" to ---the---.

Signed and Sealed this

Seventh Day of December, 1999

*Attest:*

Q. TODD DICKINSON

*Attesting Officer*

*Acting Commissioner of Patents and Trademarks*